United States Patent [19]

Kumashiro et al.

[11] Patent Number: 4,692,400

[45] Date of Patent: Sep. 8, 1987

[54] SILVER HALIDE PHOTOGRAPHIC LIGHT-SENSITIVE MATERIAL

[75] Inventors: Kenji Kumashiro, Hachioji; Toshifumi Iijima, Kokubunji; Hideo Akamatsu; Syoji Matsuzaka, both of Hachioji, all of Japan

[73] Assignee: Konishiroku Photo Industry Co., Ltd., Japan

[21] Appl. No.: 857,024

[22] Filed: Apr. 29, 1986

[30] Foreign Application Priority Data

Apr. 30, 1985 [JP] Japan ..... 60-92689

[51] Int. Cl.[4] ..... G03C 1/40; G03C 7/34; G03C 1/02

[52] U.S. Cl. ..... 430/553; 430/552; 430/567

[58] Field of Search ..... 430/552, 553, 567

[56] References Cited

U.S. PATENT DOCUMENTS

| | | | |
|---|---|---|---|
| 4,444,872 | 4/1984 | Kato et al. | 430/553 |
| 4,477,564 | 10/1984 | Cellone et al. | 430/567 |
| 4,554,244 | 11/1985 | Sato et al. | 430/553 |
| 4,614,711 | 9/1986 | Sugimoto et al. | 430/567 |

*Primary Examiner*—Richard L. Schilling
*Attorney, Agent, or Firm*—Finnegan, Henderson, Farabow, Garrett & Dunner

[57] ABSTRACT

A silver halide photographic light-sensitive material comprising a least one silver halide emulsion layer, wherein said silver halide emulsion layer comprises a phenol-type cyan coupler having at the 2-position of the penol nucleus thereof a group selected from the group consisting of a phenyl-ureido group, a naphthyl-ureido group and a heterocyclic ureido group, and having at the 5-position thereof an acylamino group, and a negative type silver halide grains of a core-shell structure which consisting of silver bromide or silver iodobromide and a plurality of shells essentially consisting of silver bromide or silver iodobromide, said plurality of shells comprising an outermost shell containing 0 to 10 mol % of silver iodide, a highly iodide-containing shell provided inside said outermost shell of which silver iodide content is at least 6 mol % of silver iodide, a highly iodide-containing shell provided inside said outermost shell of which silver iodide content is at least 6 mol % higher than that of said outermost shell, and an intermediate shell provided between said outermost shell and said highly iodide-containing shell of which a silver iodide content is at least 3 mol % higher than that of said outermost shell, and at least 3 mol % lower than that of said highly iodide-containing shell.

37 Claims, No Drawings

SILVER HALIDE PHOTOGRAPHIC LIGHT-SENSITIVE MATERIAL

BACKGROUND OF THE INVENTION

The present invention relates to a silver halide photographic light sensitive material.

Photographic silver halide emulsions have lately been more severely demanded than ever before to be improved on the photographic characteristics thereof; i.e., to be so improved as to have a higher sensitivity, more excellent graininess, higher sharpness, lower fog density, more adequately wide exposure scale, and the like.

For such demands, a silver iodobromide emulsion containing from zero to 10 mole% silver iodide are well-known as a high-sensitivity emulsion. And for the preparation of such high-sensitivity emulsions there have been conventionally known pH- and pAg-control methods such as the ammoniacal method, neutral method, and the like, and mixing methods such as the single-jet method, double-jet method, and the like.

In order to accomplish the still higher sensitivity, more improved graininess, higher sharpness and lower fog density on the basis of these known techniques, technical means therefor have been pursued to the utmost extent and made practical reality.

In silver iodobromide emulsions which are the subject of the present invention, researches have been conducted on emulsions wherein not only the crystal habit and granularity distribution thereof but also the silver iodide concentration distribution inside the individual silver halide grains thereof are controlled.

The most orthodox way to accomplish such photographic characteristics as the above-mentioned sensitivity, excellent graininess, high sharpness, low fog density, and the like, is to improve the quantum efficiency of the silver halide. Knowledge of solid state physics is positively introduced in for this purpose. A study in which the quantum efficiency is theoretically calculated to make considerations on the influence of the granularity distribution is described in, e.g., 'Interactions Between Light and Materials' p. 91, of the prepared texts for the Tokyo Symposium 1980 for the Progress in Photography. This study predicts that the preparation of a monodisperse emulsion with its granularity distribution being narrowed will be effective in improving the quanturm efficiency. And in addition, the inference that the monodisperse emulsion is also advantageous for attaining efficiently a high sensitivity with its fog remaining low in a process called 'chemical sensitization' that will be detailed hereinafter is considered reasonable.

The production of a monodisperse emulsion on an industrial scale, as is described in Japanese Patent Publication Open to Public Inspection (hereinafter referred to as Japanese Patent O.P.I. Publication) No. 48521/1979, requires the theoretically found control of the supplying rate of the silver and halogen ions to the reaction system under precise pAg and pH controls and under an adequate stirring condition of the reaction system. The silver halide grain of the emulsion produced under such conditions is in the cubic, octahedral or tetradecahederal form; that is, the emulsion comprises regular crystal grains each having (100) and (111) faces in various proportions, and such regular crystal grains are known to be highly sensitizable.

On the other hand, silver iodobromide emulsions comprising polydisperse twin grains are conventionally known as the emulsion suitable for a high-speed photographic film.

In addition, plate twin grains-containing silver iodobromide emulsions are disclosed in Japanese Patent O.P.I. Publication No. 113927/1983 and others.

On the other hand, raising the development activity, increasing the sensitivity, and the like, by the application of multistratified-type silver halide grains formed by coating a plurality of shells around the internal core are described in Japanese Patent O.P.I. Publication No. 22408/1978, Japanese Patent Examined Publication No. 13162/1968, J. Photo. Sci., 24, 198 (1976), and the like.

The silver halide grain provided with coat stratums by the halogen substitution as the outermost stratum thereof is described in West German Pat. No. 2932650, Japanese Patent O.P.I. Publication Nos. 2417/1976, 17436/1976, 11927/1977, and the like. However, such silver halide grains are not practically applicable as the grains for a negative emulsion in respect that they, although capable of accelerating the fixing rate, restrain the development to the contrary, thus being unable to provide any adequate sensitivity.

And positive-type (internal latent image-type) silver halide grains each having outside the core thereof a plurality of coat stratums by the halogen substitution are known and detailed in U.S. Pat. Nos. 2,592,250 and 4,075,020, Japanese Patent O.P.I. Publication No. 127549/1980, and the like. Such silver halide grains are those frequently used in the internal latent image-type direct positive light-sensitive material for use in the diffusion transfer process and are by no means applicable to any one or ordinary negative-type emulsions because the internal sensitivity thereof is excessively high.

Meanwhile, Japanese Patent O.P.I. Publication Nos. 181037/1983, 35726/1985, 116647/1984, and the like, also disclose those silver halide grains each having shell stratums around the internal core thereof, the shell stratums each containing a diverse amount of iodide.

In the silver halide photographic light-sensitive material's field, color light-sensitive materials whose sensitivity exceeds an ISO speed index of 1000 have in recent years made their appearance thanks to the remarkable progress in various techniques. However, it is the status quo that such light-sensitive materials, since they become, without exception, deteriorated in the sharpness as well as in the graininess as their sensitivity goes up, produce images inferior in quality to those from conventional light-sensitive materials, thus being unsatisfactory for the appreciation by consumers. Upon this, great hope has now been placed on the realization of high-speed light-sensitive materials excellent in the sharpness as well as in the graininess.

In the astrophotography, indoor photography or sports photography, still higher-speed negative-type light-sensitive materials are indispensable.

A color image is usually obtained as a result of the formation of a dye image by the coupling reaction of couplers with the oxidized product of a color developing agent. In a multicolor photographic element, the subtractive method is usually used for the color image formation, and the dyes to be formed by the coupling may be normally the cyan, magenta and yellow dyes which are formed in the respective silver halide emulsion layers or other layers adjacent thereto, the emulsion layers being sensitive to the wavelength regions the rays of which are absorbed by the image dyes; i.e., sensitive to the red, green and blue regions of the spectrum.

Those couplers forming these dyes are desirable to be such that the color dye produced therefrom be very sharp in its hue; be excellent in the color reproducibility; cause no such discoloration as reduction discoloration; and be excellent in the produced dye cloud's graininess.

Those phenols and naphthols conventionally used as the cyan coupler to be contained in a silver halide emulsion having the sensitivity thereof in the red region of the spectrum are couplers excellent in the color reproducibility because the absorption maximum (λmax) of the color-formed dye therefrom is generally in a longer wavelength region and the sub-absorption thereof in the green region is small. These couplers, however, have the disadvantages that the dye formed therefrom is generally discolored in a weak-oxidation bleach-fix process to form a leuco dye, thus causing a failure in the color formation.

In order to solve such the disadvantage, the use of a cyan coupler not causing any reduction discoloration in the bleach or bleach-fix process is required, and as the cyan coupler of this type, e.g., British Pat. No. 1,011,940, U.S. Pat. Nos. 3,446,622, 3,996,253, 3,758,308, 3,880,661, and the like, disclose those phenol-type cyan couplers having an ureido group in the second position thereof. However, these couplers are unfavorable in respect of the color reproducibility because the absorption spectrum of each of the dyes formed therefrom has a sub-absorption in a shorter-wavelength region.

On the other hand, those ureido-phenol-type cyan couplers having a specific ureido group in the second position of the phenol and an acylamino group in the fourth position of the phenol, which are described in Japanese Patent O.P.I. Publication No. 65134/1981, are known as the coupler improved so that the cyan dye formed therefrom is not discolored and the cyan dye's absorption maximum in the spectrum is in a relatively longer wavelength region. However, it has now been found as a result of our investigation that the use of such ureido-type cyan couplers causes outstanding deterioration of the sensitivity as well as of the graininess of film where the film has been allowed to stand over a long period of time, particularly, under high temperature/-high humidity conditions.

SUMARY OF THE INVENTION

It is therefore an object of the present invention to provide a silver halide photographic light-sensitive material which causes no complex color trouble of the cyan dye image, which is excellent in the graininess, and which is improved on the stability in aging; particularly excellent in the preservability under high temperature and high humidity conditions.

That is, the present invention can be achieved with a silver halide photographic light-sensitive material which comprises light-sensitive silver halide emulsion layers at least one layer of which comprises at least one of phenol-type cyan couplers having in the second position thereof a group selected from the class consisting of phenyl-ureido, naphtyl-ureido and heterocyclic ureido groups and in the fifth position thereof an acylamino group; at least one layer of the light-sensitive silver halide emulsion layers comprising negative-type silver halide grains comprised of an internal core consisting substantially of silver bromide and/or silver iodobromide and a plurality of shell stratums being provided around the internal core and consisting substantially of silver bromide and/or silver iodobromide, a plurality of shell stratums comprising the outermost shell stratum, intermediate shell stratum and internal shell stratum, the outermost shell stratum containing equal to or less than 10 mole% iodide, the internal shell stratum being a high-silver iodide-containing shell (hereinafter called 'high-iodide shell') containing iodide 6 mole% more than that of the outermost shell stratum, the intermediate shell stratum containing a medium amount of iodide and being provided between the outermost shell stratum and the high-iodide shell stratum and containing iodide 3 mole% more than that of the outermost shell stratum, the high-iodide shell stratum containing iodide 3 mole% more than that of the intermediate shell stratum.

DETAILED DESCRIPTION OF THE INVENTION

In the silver halide composition of the core/shell type silver halide grains of the present invention, the phrase '. . . consisting substantially of . . . ' used herein means that any silver halide other than the silver bromide or silver iodobromide, for example, silver chloride, is allowed to be contained to such an extent as not to impair the effect of this invention; to be concrete, in the case of silver chloride, the allowable silver chloride content is desirable to be not more than 1 mole%.

The features of the photographic light-sensitive material of this invention will be given in the following (1)~(8):

(1) The use of an emulsion containing core/shell-type silver halide grains having thereinside a high-iodide shell enables to obtain a higher sensitivity, wider exposure scale, and more excellent graininess (than non-core/shell-type emulsions).

(2) The provision of an intermediate shell stratum having a medium iodide content between the high-iodide shell stratum and the outermost low-iodide shell stratum enables to obtain a still higher sensitivity.

(3) The iodide content of the high-iodide stratum is preferably from 6 to 40 mole%, and 6 mole% more than the outermost shell stratum, but if the content is less than 6 mole% (or only 6 or less mole% more than the outermost shell stratum), the sensitivity becomes lowered, while if the content exceeds 40 mole%, the emulsion becomes polydisperse, and from the standpoint of the sensitivity and sharpness, the content is desirable not to exceed 40 mole%.

(4) The differences in the iodide content between the intermediate shell and outermost shell stratums and between the intermediate shell and high-iodide shell stratums should each be equal to or more than 3 mole%. This is because, if the difference is too small, the effect of the intermediate shell is reduced (the sensitivity goes down). And the difference in the iodide content is desirable to be up to 35 mole% from the standpoint of deriving efficiently the intermediate shell's effects (sensitivity, monodispersibility, fog-sensitivity relation and sharpness).

(5) The iodide content percentage of the whole silver halide grains, if too high, deteriorates the developability and sensitivity, while if too low, tends to make the gradation too contrasty and the exposure range too narrow and to deteriorate the graininess, so that a reasonably specified iodide content range is desirable to be selected.

(6) The monodisperse emulsion is superior in the sensitivity, sharpness, and fog-sensitivity relation to the polydisperse emulsion; that is, in the polydisperse emulsion, since the reaction to form the shell is not uniform, an ideal core/shell structure is hardly formed; minute particles to deteriorate the sharpness is present; and because the chemical sensitization's optimum condition after the formation of grains differs depending on each individual grain, not only the sensitivity but also the fog-sensitivity relation tend to be deteriorated, whereas the monodisperse emulsion shows no such tendencies. Consequently, the monodisperse emulsion is favorably used.

(7) In a multilayered color light-sensitive material there occurs a phenomenon by forming a plurality of layers to cause the sensitivity to become inferior to that of a single-layered light-sensitive material (the phenomenon called interlayer desensitization effect), but the emulsion of this invention, since not only is its single layer's sensitivity high but also it is hardly subject to the interlayer desensitization effect, can be more effectively used in the form of a multilayered color light-sensitive material.

(8) In the invention, a light-sensitive material particularly excellent in sensitivity, graininess, stability in aging and the like can be obtained by making use of the core/shell-type silver halide grains and the foregoing phenol-type cyan couplers in combination, which all will be described hereinafter.

In order to further improve the above-mentioned effects, if the iodide content (mole%) of the high-iodide shell is regarded as Ih; the iodide content (mole%) of the intermediate shell as Im; and the iodide content (mole%) of the outermost shell as Il, the respective contents and the relations therebetween should be preferably $\Delta I = Ih - Il > 8$ mole%, $\Delta Ih = Ih - Im > 4$ mole%, and $\Delta Il = Im - Il > 4$ mole%, and more preferably $\Delta I > 10$ mole%, $\Delta Ih > 4$ mole%, and $\Delta Il > 4$ mole% {the foregoing (4)}, wherein Il should be equal to 0~5 mole%, preferably equal to 0~2 mole%, and more preferably equal to 0~1 mole%; and Ih should be equal to 6~40 mole%, and more preferably equal to 10~40 mole% {the foregoing (3)}.

The volume of the outermost shell should be from 4 to 70% of the whole grain, and more preferably from 10 to 50%. The volume of the high-iodide shell should be from 10 to 80% of the whole grain, preferably from 20~50%, and more preferably from 20 to 45%. The volume of the intermediate shell should be from 5 to 60% of the whole grain, and more preferably from 20 to 55%. The high-iodide shell may be at least part of the internal core, but the inner side of the high-iodide shell should be preferably provided with another internal core.

The iodide content of the internal core should be from zero up to 40 mole%, preferably from zero up to 10 mole%, and more preferably up to 6 mole%. The diameter of the internal core should be from 0.05 to 0.8 μm, and more preferably from 0.05 to 0.4 μm.

Also, in the foregoing feature (5) the iodide content of the whole grain should be from 1 to 20 mole%, preferably from 1 to 15 mole%, and much preferably from 2 to 12 mole%. In the foregoing feature (6), regarding the granular diameter distribution, the emulsion may be either polydisperse or monodisperse, but it should be a monodisperse emulsion whose granular diameter distribution's coefficient of variation is preferably equal to or less than 20%, and more preferably equal to or less than 15%, wherein the coefficient of variation is defined as $$\text{Coefficient of variation (\%)} = \frac{\text{Granular diameter's standard deviation}}{\text{Average of granular diameter}} \times 100$$

and this is a measure for expressing the monodispersibility.

The granular diameter of the silver halide grain (defined as the length of a side of the cube whose volume corresponds to that of the silver halide grain) should be from 0.1 to 3.0 μm, and the form thereof may be any of the octahedral, cubic, spherical, or plate form, and should preferably be octahederal.

Referring further to the stratified structure of the silver halide grain relating to the present invention, the internal core and the high-iodide shell may be the same as has been mentioned above or otherwise a different internal core may be provided inside the high-iodide shell. The internal core and high-iodide shell, the high-iodide shell and intermediate shell, and the intermediate shell and outermost shell may be adjacent to each other, or otherwise may have therebetween at least one different shell stratum of an arbitrary composition (called an arbitrary shell).

Such the arbitrary shell may be a single shell of an uniform composition or comprised of a plurality of uniform-composition shells or a group of shells whose composition varies by stages or a continuous shell, an arbitrary shell, whose composition varies continuously or a combination of these shells. And the high-iodide shell and the intermediate shell each may be a plurality of shells or a single shell.

Subsequently, examples of the stratified construction of the silver halide grain of the present invention will be described below, wherein the iodide content is shown with 'I'.

1. Internal core = three-stratum structure of high-iodide shell:

| | Iodide content | Shell diameter |
|---|---|---|
| core (Internal core = high-iodide shell) | | |
| $I_3 - I_2 > 3$ mol % | $I_2 = 15$ mol % | 1.2 μm |
| 2nd shell (Intermediate shell) | | |
| $I_2 - I_1 > 3$ mol % | $I_2 = 5$ mol % | 1.4 μm |
| 1st shell (Outermost shell) | | |
| $I_1 = 0 \sim 10$ mol % | $I_2 = 0.5$ mol % | 1.6 μm |

2. Six-stratum structure comprising fourth and fifth arbitrary-composition shells between the internal core and the high-iodide shell:

| | Iodide content | Shell diameter |
|---|---|---|
| Core (6th) (Internal core) | | |
| Arbitrary | $I_6 = 4.0$ mol % | 0.1 μm |
| 5th shell (−) | | |
| Arbitrary | $I_5 = 2.0$ mol % | 0.27 μm |
| 4th shell (−) | | |
| Arbitrary | $I_4 = 2.6$ mol % | 0.8 μm |
| 3th shell (High-iodide shell) | | |
| $I_3 - I_2 > 3$ mol % | $I_3 = 15.0$ mol % | 1.12 μm |
| 2nd shell (Intermediate shell) | | |
| $I_2 - I_1 > 3$ mol % | $I_2 = 5.0$ mol % | 1.44 μm |
| 1st shell (Outermost shell) | | |

-continued

| | Iodide content | Shell diameter |
|---|---|---|
| $I_1 = 0 \sim 10$ mol % | $I_1 = 0.5$ mol % | 1.6 μm |

3. Seven-stratum structure comprising fifth and sixth arbitrary shells between the internal core and the high-iodide shell and also comprising two inter-shell stratums between the outermost shell and the high-iodide shell:

| | Iodide content | Shell diameter |
|---|---|---|
| 7th shell (Internal core) | | |
| Arbitrary | $I_7 = 4$ mol % | 0.1 μm |
| 6th shell (Arbitrary shell inserted) | | |
| Arbitrary | $I_6 = 2$ mol % | 0.27 μm |
| 5th shell (Arbitrary shell inserted) | | |
| Arbitrary | $I_5 = 8$ mol % | 0.8 μm |
| 4th shell (High-iodide shell) | | |
| $I_4 - I_3 > 3$ mol % | $I_4 = 15$ mol % | 1.12 μm |
| 3rd shell (Intermediate shell) | | |
| $I_3 - I_1 > 3$ mol % | $I_3 = 8$ mol % | 1.24 μm |
| $I_4 - I_3 > 3$ mol % | | |
| 2nd shell (Intermediate shell) | | |
| $I_2 - I_1 > 3$ mol % | $I_2 = 4$ mol % | 1.44 μm |
| $I_4 - I_2 > 3$ mol % | | |
| 1st shell (Outermost shell) | | |
| $I_1 = 0 \sim 10$ mol % | $I_1 = 0.5$ mol % | 1.6 μm |

4. Eight-stratum structure comprising sixth and seventh arbitrary shells between the internal core and the high-iodide shell, one arbitrary shell (fourth shell) between the high-iodide shell (fifth shell) and the intermediate shell (third shell), and one arbitrary shell (second shell) between the intermediate shell (third shell) and the outermost shell (second shell):

| | Iodide content | Shell diameter |
|---|---|---|
| 8th shell (Internal core) | | |
| Arbitrary | $I_8 = 4$ mol % | 0.10 μm |
| 7th shell (Arbitrary shell) | | |
| Arbitrary | $I_7 = 2$ mol % | 0.27 μm |
| 6th shell (Arbitrary shell) | | |
| Arbitrary | $I_6 = 4$ mol % | 0.8 μm |
| 5th shell (High-iodide shell) | | |
| $I_5 - I_3 > 3$ mol % | $I_5 = 15$ mol % | 1.12 μm |
| 4th shell (Arbitrary shell) | | |
| Arbitrary | $I_4 = 9$ mol % | 1.24 μm |
| 3rd shell (Intermediate shell) | | |
| $I_3 - I_1 > 3$ mol % | $I_3 = 5$ mol % | 1.44 μm |
| 2nd shell (Arbitrary shell) | | |
| Arbitrary | $I_2 = 4.5$ mol % | 1.50 μm |
| 1st shell (Outermost shell) | | |
| $I_1 = 0 \sim 10$ mol % | $I_1 = 2$ mol % | 1.6 μm |

5. Structure having a plurality of high-iodide shells:

| | Iodide content | Shell diameter |
|---|---|---|
| 6th shell (Internal core) | | |
| Arbitrary | $I_6 = 4$ mol % | 0.10 μm |
| 5th shell (High-iodide shell) | | |
| $I_5 - I_2 > 3$ mol % | $I_5 = 15$ mol % | 0.27 μm |
| $I_5 - I_1 > 6$ mol % | | |
| 4th shell (Arbitrary shell) | | |
| Arbitrary | $I_4 = 5$ mol % | 0.80 μm |
| 3rd shell (High-iodide shell) | | |
| $I_3 - I_2 > 3$ mol % | $I_3 = 15$ mol % | 1.12 μm |
| $I_3 - I_1 > 6$ mol % | | |
| 2nd shell (Intermediate shell) | | |
| $I_2 - I_1 > 3$ mol % | $I_2 = 5$ mol % | 1.44 μm |
| 1st shell (Outermost shell) | | |

-continued

| | Iodide content | Shell diameter |
|---|---|---|
| $I_1 = 0 \sim 10$ mol % | $I_1 = 0.3$ mol % | 1.60 μm |

The internal core of the silver halide grain relating to the present invention may be prepared by any of those methods as described in 'Chimie et Physique Photographique' by P. Glafkides (published by Paul Montel in 1967), 'Photographic Emulsion Chemistry' by G. F. Duffin (The Focal Press, 1966), 'Making and Coating Photographic Emulsion' by V. L. Zelikman et al (The Focal Press, 1964), and the like. Namely, it may be prepared using any method including the acidic method, neutral method, ammoniacal method, etc., with any mixing method for the reaction of the water-soluble silver salt with the water-soluble halide including a single-jet method, a double-jet method, and a combination of these methods.

A method in which the grain is formed in the presence of an excess of silver ions (the so-called reverse-mixing method) may also be used. In addition, a method, as one of double-jet methods, which is carried out with the pAg in the liquid phase for forming a silver halide being maintained constant; i.e., the controlled double-jet method, may be used as well. This method enables to obtain a silver halide emulsion having regular-crystalline and uniform-size silver halide grains.

Separately formed two or more silver halide emulsions may be mixed, but the use of the double-jet method or controlled double-jet method is preferred.

The pAg in preparing the internal core varies according to the reaction temperature and the kind of the silver halide solvent used, but is preferably from 2 to 11. The use of the silver halide solvent is preferred because it enables to shorten the grain forming time. Examples of the silver halide solvent usable include well-known silver halide solvents such as ammonia, thioether, and the like.

The configuration of the internal core used may be any of plate, spherical, twin, octahedral, cubic or tetradecahedral form, or complex of these forms.

In order to make the grain size uniform, it is desirable to grow fast the grain to the extent not to exceed the critical saturation degree by using those methods for varying the adding rate of silver nitrate and halogenated alkaline solutions according to the growth rate of the grain as described in British Pat. No. 1,535,016, Japanese Patent Examined Publication Nos. 36890/1973 and 16364/1977, or those methods for varying the aqueous solution's concentration as described in U.S. Pat. No. 4,242,445 and Japanese Patent O.P.I. Publication No. 158124/1980. These methods may be advantageously used also in introducing the arbitrary shell, high-iodide shell, intermediate shell and outermost shell because the coat on each silver halide grain can be made without the occurrence of another core.

A single or a plurality of arbitrary shells may at need be provided between the high-iodide shell and the internal core of the silver halide grain relating to the present invention. This high-iodide shell may be provided by an ordinary halogen substitution method or silver halide coating method, etc., after subjecting the desalting process, if necessary, to the formed internal core or to the arbitrary shell-provided internal core.

The halogen substitution method may be carried out after the formation of the internal core, for example, by the addition of an aqueous iodide compound (preferably potassium iodide) solution, preferably equal to or less than 10% solution; more particularly, it may be carried out by any of those methods as described in U.S. Pat. Nos. 2,592,250 and 4,075,020, and Japanese Patent O.P.I Publication No. 127549, and the like. In this instance, in order to lessen the difference in the iodide distribution in the high-iodide shell between the grains, it is desirable to make the aqueous iodide solution's concentration equal to or less than $10^{-2}$ mole% and to add the solution spending more than ten minutes.

Newly coating a silver halide over the internal core may be carried out by, e.g., adding aqueous halide and silver nitrate solutions simultaneously, i.e., the double-jet method, or the controlled double-jet method, and more particularly by any of those methods as described in Japanese Patent O.P.I. Publication No. 22408/1978, Japanese Patent Examined Publication No. 13162/1968, Japanese Patent O.P.I. Publication No. 14829/1983, J. Photo. Sci. 24,198 (1976), and the like.

The pAg in forming the high-iodide shell, although it varies according to the reaction temperature, the kind and quantity of the silver halide solvent used, may be as described previously, and where ammonia is used, is desirable to be from 7 to 11.

The formation of the high-iodide shell may be made more preferably by the double-jet method or the controlled double-jet method.

The intermediate shell of the silver halide grain relating to this invention may be provided through coating by the double-jet method or by the controlled double-jet method on the external of the grain containing the high-iodide shell having a high-iodide shell surface or having thereon, if necessary, a single or a plurality of arbitrary shells and the internal core a further silver halide of a halide composition different from the halide composition of the high-iodide shell.

For this purpose the previously mentioned method for the high-iodide shell may be similarly used.

The outermost shell of the silver halide grain relating to this invention may be provided through coating by the double-jet method or by the controlled double-jet method on the external of the grain containing the intermediate shell having the intermediate shell surface or having a single or a plurality of arbitrary shells, the high-iodide shell and the internal core a further silver halide of a halide composition different from the halide composition of the high-iodide shell.

For this purpose the previously mentioned method for providing the high-iodide shell may be similarly used.

The arbitrary shell can be one stratum each or a plurality of strata each provided between the internal core and the high-iodide shell, between the high-iodide shell and the intermediate shell, and between the intermediate shell and the outermost shell, or otherwise the arbitrary shell is allowed not to be provided. For such arbitrary shells the previously mentioned method for the high-iodide shell is similarly usable. In the internal core, high-iodide shell, intermediate shell, outermost shell, and arbitrary shells to be provided in the respective positions, in the course of providing any such adjacent shells, if necessary, a desalting process may take place in usual manner, or otherwise the formation of the shells may be continued without the desalting process.

The iodide content of each shell of the silver halide grain relating to the present invention may be found according to the method described in, e.g., J. I. Goldstein, D. B. Williams 'X-Ray Analysis in TEM/ATEM' in Scanning Electron Microscopy (1977) Vol. No. 1 (IIT Research Institute, p. 651 (March 1977)); 'Annual Meeting of SPSTJ '84', p 49~51 (1984); 'The International East-West Symposium on the Factors Influencing Photographic Sensitivity (1984)', c-60~c-63 (1984); Japanese Patent O.P.I. Publication No. 143331/1985 and Japanese Patent O.P.I. Publication No. 143332.

In an emulsion containing silver halide grains as the final product after the formation of the outermost shell, the excess of the halide compound produced at the time of the preparation or the secondarily produced or disused salts such as the nitrate, ammonia, etc., or compounds may be removed from the dispersion medium of the silver halide grain. The removal may be arbitrarily made in accordance with the noodle washing method or dialysis method, commonly used for ordinary emulsions, or the flocculation method, utilizing inorganic salts, anionic surfactants, anionic polymers (such as polystyrenesulfonic acid) or gelatin derivatives (such as acylated gelatin, carbamylated gelatin), and the like.

The core/shell-type silver halide grains relating to the present invention may be optically sensitized to desired wavelength regions. The invention places no particular restrictions on the method of optical sensitization; for example, the optical sensitization may be made by using alone or in combination cyanine dyes such as zeromethine dyes, monomethine dyes, dimethine dyes, trimethine dyes, etc., or optical sensitizers such as merocyanine dyes and the like. Combinations of such sensitizers are frequently used particularly for the purpose of supersensitization. Along with such sensitizers the emulsion may also contain a dye which itself has no spectral sensitization effect or a substance substantially not absorbing visible rays but exhibits supersensitization effect. These techniques are described in U.S. Pat. Nos. 2,688,545, 2,912,329, 3,397,060, 3,615,635 and 3,628,964, British Pat. Nos. 1,195,302, 1,242,588 and 1,293,862, West German OLS Patent Nos. 2,030,326 and 2,121,780, Japanese Patent Examined Publication Nos. 4936/1968 and 14030/1969, and also described in Research Disclosure Vol. 176, 17643 (Dec. 1978). The selection of these materials may be arbitrarily made according to the purpose and the use of the light-sensitive material, such as the wavelength region to which the light-sensitive material should be sensitized, the sensitivity, and the like.

The core/shell-type silver halide crystal relating to the present invention may be chemically sensitized by being subjected to various chemical sensitization treatments which are usually applied to general emulsions.

For the chemical sensitization those methods may be used which are described in 'Die Grundlagen der Photographische Prozesse mit Silberhalogeniden' edited by H. Frieser (Akademische Verlagsgesellschaft, 1968) 675~734. That is, the sulfur sensitization method, which uses compounds containing sulfur capable of reacting with silver ions or active gelatin, the reduction sensitization method, which uses reductive materials, the noble metal sensitization method, which uses gold or other noble-metallic compounds, and the like, may be used alone or in combination. Examples of the sulfur sensitizer include thiosulfates, thioureas, thiazoles, rhodanines, and other compounds, of which contrete examples are described in U.S. Pat. Nos. 1,574,944, 2,410,689, 2,278,947, 2,728,668, 3,656,955, 4,032,928 and 4,067,740. Examples of the reduction sensitizer include stannous salts, amines, hydrazine derivatives, formamidinesulfinic acid, silane compounds, and the like, of which concrete examples are described in U.S. Pat. Nos. 2,487,850, 2,419,974, 2,518,698, 2,983,609, 2,983,610, 2,694,637, 3,930,867 and 4,054,458. For the noble-metallic sensitization, in addition to gold complex salts, those complex salts of metals belonging to Group VIII of the periodic table such as platinum, iridium, palladium, and the like, may be used, of which concrete examples are described in U.S. Pat. Nos. 2,399,083 and 2,448,060, and British Patent No. 618,061 and the like.

The chemical sensitization of the silver salt of this invention may be carried out by using in combination two or more of these chemical sensitization methods.

The coating amount of silver may be arbitrarily settled, and is preferably from 1000 mg/m$^2$ to 15000 mg/m$^2$, and more preferably from 2000 mg/m$^2$ to 10000 mg/m$^2$.

The light-sensitive layer containing the silver halide grain may be allowed to be present on both sides of a support.

Various types of dopant may be used for doping each shell of the core/shell-type emulsion of the present invention at the time of the formation thereof, of which those usable as the internal dopant include, e.g., silver, sulfur, iridium, gold, platinum, osmium, rhodium, tellurium, selenium, cadmium, zinc, lead, thalium, iron, antimony, bismuth, arsenic, and the like. For the doping of any of these dopants water-soluble salts or complex salts of such dopants may be made present together with the respective shells.

Those phenol-type cyan couplers, advantageously usable in the silver halide photographic light-sensitive material of the present invention, having in the second position thereof a group selected from the class consisting of phenylureido, naphthylureido and heterocyclic ureido groups and in the fifth position thereof an acylamino group are represented by the following general formula [Ia] or [Ib], and preferably formula [Ia].

Formula [Ia]

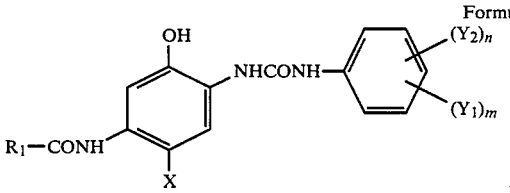

Formula [Ib]

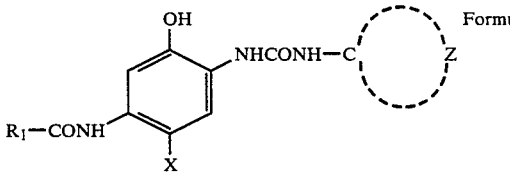

wherein $Y_1$ is a trifuloromethyl group, a nitro group, a halogen atom (such as fluorine, chlorine, bromine), a cyano group, —COR, —COOR, —$SO_2R$, —$SO_2R$,

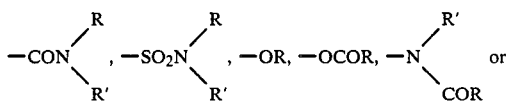

-continued

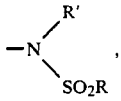

wherein R is an aliphatic group {preferably an alkyl group having from 1 to 10 carbon atoms (such as methyl, butyl, cyclohexyl, benzyl)} or an aromatic group }preferably a phenyl group (such as phenyl tolyl)}, and R′ is a hydrogen atom or a group as defined in the above R; $Y_2$ is a monovalent group, preferably an aliphatic group {more preferably a straight-chain or branched-chain alkyl group having from 1 to 10 carbon atoms (such as methyl, t-butyl, ethoxyethyl, cyanomethyl)}, an aromatic group {preferably a phenyl or naphthyl group (such as phenyl, tolyl)}, a halogen atom (such as fluorine, chlorine, bromine), an alkylamino group (such as ethylamino, diethylamino), a hydroxy group, a cyano group, or a substituent represented by the above $Y_1$; m is an integer of from 1 to 3; and n is an integer of from zero up to 3; provided that m+n is equal to or less than 5.

Z represents a group of metals necessary to form a heterocyclic group or a naphthyl group, the heterocyclic group being desirable to be a 5- or 6-member heterocyclic group containing one through four nitrogen atoms, oxygen atoms, or sulfur atoms, such as, for example, a furyl group, a thienyl group, a pyridyl group, a quinolyl group, a oxazolyl group, a tetrazolyl group, a benzothiazolyl group, a tetrahydrofuranyl group, or the like.

These rings each may have a substituent. Examples of the substituent include, e.g., alkyl groups having from 1 to 10 carbon atoms (such as ethyl, i-propyl, i-butyl, t-butyl, t-octyl), aryl groups (such as phenyl, naphthyl), halogen atoms (such as fluorine, chlorine, bromine), cyano group, nitro group, sulfonamido groups (such as methanesulfonamido, butanesulfonamido, p-toluenesulfonamido), sulfamoyl groups (such as methylsulfamoyl, phenylsulfamoyl), sulfonyl groups (such as methanesulfonyl, p-toluenesulfonyl), fluorosulfonyl group, carbamoyl groups (such as dimethylcarbamoyl, phenylcarbamoyl), oxycarbonyl groups (such as ethoxycarbonyl, phenoxycarbonyl), acyl groups (such as acetyl, benzoyl), heterocyclic groups (such as pyridyl, pyrazolyl), alkoxy groups, aryloxy groups, acyloxy groups, and the like.

$R_1$ is a ballasting group necessary to provide nondiffusibility to the phenol-type cyan coupler having the foregoing formula [Ia] or [Ib] and the cyan dye formed therefrom, the ballasting group representing, e.g., an aliphatic group, an aromatic group or a heterocyclic group, and preferably an alkyl, aryl or heterocyclic group each having from 4 to 30 carbon atoms; for example, a straight-chain or branched-chain alkyl group (such as t-butyl, n-octyl, t-octyl, n-dodecyl), an alkenyl group, a cycloalkyl group, a 5- or 6-member heterocyclic group, or the like.

The preferred groups represented by $R_1$ are those having the following general formula [Ic]:

Formula [Ic]

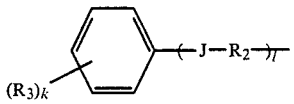

wherein J represents an oxygen atom or a sulfur atom; k is an integer of up to 4; and l is zero or 1; a plurality of $R_3$s existing when k is equal to or more than 2 may be either the same or different; $R_2$ is a straight-chain or branched-chain alkylene group having from 1 to 20 carbon atoms; $R_3$ is a monovalent group such as, e.g., a hydrogen atom, a halogen atom (preferably chlorine or bromine), an alkyl group [preferably a straight-chain or branched-chain alkyl group having from 1 to 20 carbon atoms (such as methyl, t-butyl, t-pentyl, t-octyl, dodecyl, pentadecyl, benzyl, phenethyl)], an aryl group (such as phenyl), a heterocyclic group (preferably a nitrogen-containing heterocyclic group), an alkoxy group [preferably a straight-chain or branched-chain alkoxy group having from 1 to 20 carbon atoms (such as methoxy, ethoxy, t-butyloxy, octyloxy, decyloxy, dodecyloxy)], an aryloxy group (such as phenoxy), a hydroxy or acyloxy group [preferably an alkylcarbonyloxy or arylcarbonyloxy group (such as acetoxy, benzoyloxy)], a carboxy group, an alkyloxycarbonyl group (preferably a straight-chain or branched-chain alkyloxycarbonyl group), an aryloxycarbonyl group (preferably phenoxycarbonyl group), an alkylthio group (preferably an alkylthio group having from 1 to 20 carbon atoms), an acyl group (preferably a straight-chain or branched-chain alkylcarbonyl group), an acylamino group (preferably a straight-chain or branched-chain alkylcarboamido or benzenecarboamido group having from 1 to 20 carbon atoms), a sulfonamido group (preferably a straight-chain or branched-chain alkylsulfonamido or benzenesulfonamido group having from 1 to 20 carbon atoms), a carbamoyl group (preferably a straight-chain or branched-chain alkylaminocarbonyl or phenylaminocarbonyl group having from 1 to 20 carbon atoms), a sulfamoyl group (preferably a straight-chain or branched-chain alkylaminosulfonyl or phenylaminosulfonyl group having from 1 to 20 carbon atoms), or the like.

In Formulas [Ia] and [Ib], X represents a hydrogen atom or a group which can be split off at the time of the coupling reaction with the oxidized product of a color developing agent. Examples of such the splittable group include, e.g., aryloxy groups, carbamoyloxy groups, carbamoylmethoxy groups, acyloxy groups, sulfonamido groups, succinic acid imido groups, etc., to the coupling position of each of which groups is bonded directly a hologen atom (such as chlorine, bromine, fluorine), an oxygen atom or a nitrogen atom, and further include those, as concrete examples, described in U.S. Pat. No. 3,741,563, Japanese Patent O.P.I. Publication No. 37425/1972, Japanese Examined Publication No. 36894/1973, Japanese Patent O.P.I. Publication Nos. 10135/1975, 117422/1975, 130441/1975, 108841/1976, 120334/1975, 18315/1977, 105226/1978, 14736/1979, 48237/1979, 32071/1980, 65957/1980, 1938/1981, 12643/1981 and 27147/1981.

The ureido-type cyan couplers of the present invention may be synthesized in accordance with those methods as described in, e.g., U.S. Pat. No. 3,758,308 and Japanese Patent O.P.I. Publication No. 65134/1981, and the like.

Typical examples of the synthesis of the ureido-type cyan coupler of the present invention will be described below:

The ureido-type cyan coupler of the present invention may be synthesized in principle through the following synthesis route:

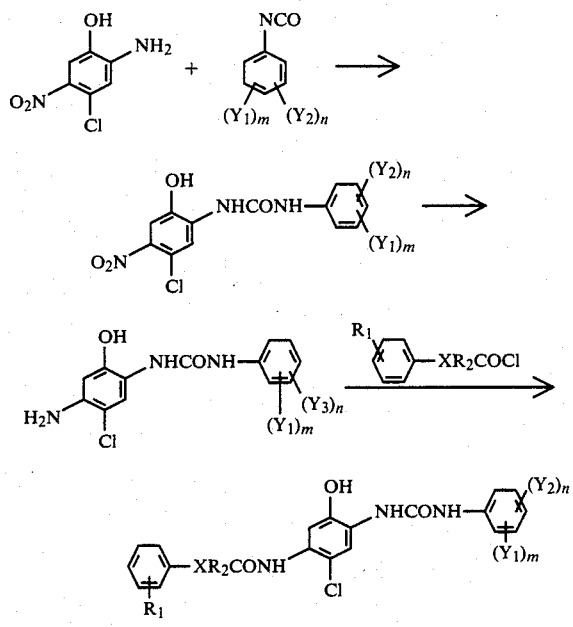

SYNTHESIS EXAMPLE 1

(Synthesis of the following exemplified Coupler 2)

Synthesis of 2-(3-ethoxycarbonylphenyl)-ureido-4-chloro-5-[α-(4-butylsulfonylamidophenoxy)tetradecaneamido]phenol:

Eighteen point nine grams of 2-amino-4-chloro-5-nitrophenol were dispersed into 200 ml of toluene, and to the mixture, with stirring at room temperature, were added 100 ml of a toluene solution containing 21 g of 3-ethoxycarbonylphenyl isocyanate. The obtained reaction mixture was refluxed by boiling for an hour, and then cooled to room temperature. The resulting crystals were filtered, washed with methanol, and then dried, whereby 34 g of a light-yellow solid, m.p. 261°~266° C., were obtained.

Nineteen grams of 2-(3-ethoxycarbonylphenyl-)ureido-4-chloro-5-nitrophenol were added to 600 ml of an alcohol to be subjected to catalytic reduction by using a palladium-carbon catalyst. After the consumption of a theoretical amount of hydrogen the catalyst was filtered off, and the filtrate was concentrated under reduced pressure, whereby 17 g of a reaction crude product were obtained.

Three point five grams of 2-(3-ethoxycarbonylphenyl)ureido-4-chloro-5-aminophenol were dissolved uniformly into a mixture liquid of 100 ml of acetonitrile and 0.9 ml of pyridine, and to this were added, with stirring at room temperature, 50 ml of an acetonitrile solution containing 4.7 g of α-(4-butylsulfonylamidophenoxy)tetradecanoyl chloride.

After completion of the addition the reaction was continued for another hour, and then to the reaction liquid was added iced water, and ethyl acetate was used to obtain an extract from the liquid. After washing the extract the ethyl acetate phase was separated and then dried by use of sodium sulfate, and then concentrated under reduced pressure, whereby an objective extract was obtained.

The reaction crude product was refined by used of silica gel and column chromatography, and solidified by use of hexane, whereby 3.7 g of a white solid, m.p. 146°~149° C., were obtained. The results of elemental analysis (%):
| | C | H | N | Cl | S |
|---|---|---|---|---|---|
| Calculated | 61.01 | 7.04 | 7.12 | 4.50 | 4.07 |
| Found | 59.89 | 7.12 | 7.09 | 4.62 | 3.84 |
The following are the preferred ureido-type cyan couplers of the present invention. The present invention is not limited to and by the examples.
C-1
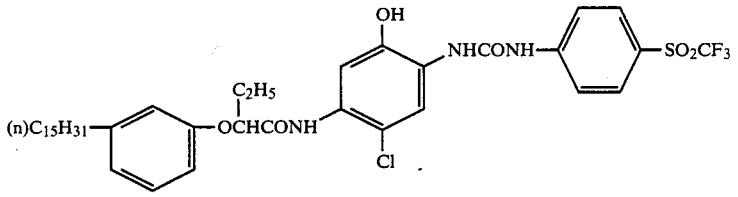
C-2
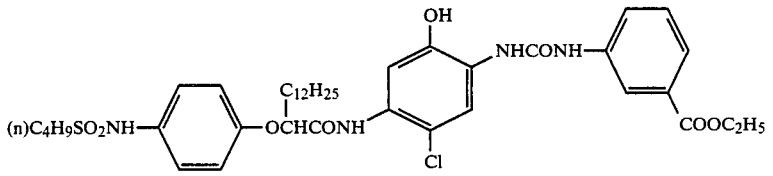
C-3
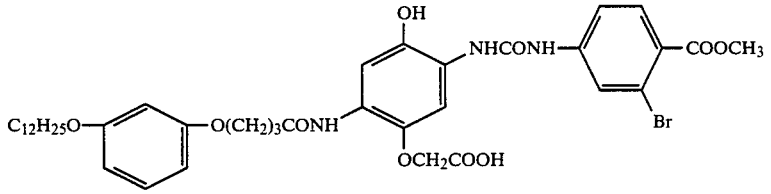
C-4
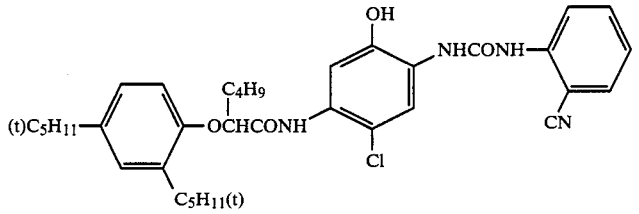
C-5
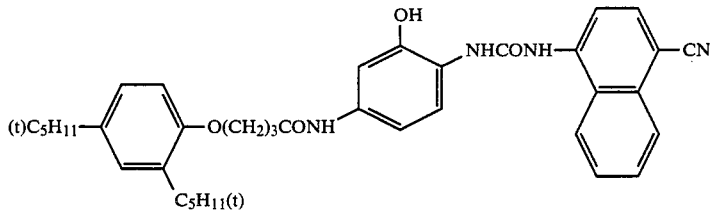
C-6
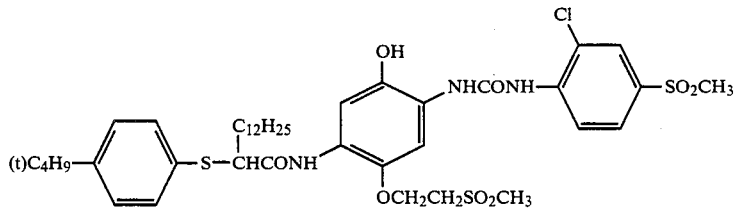

-continued
C-7
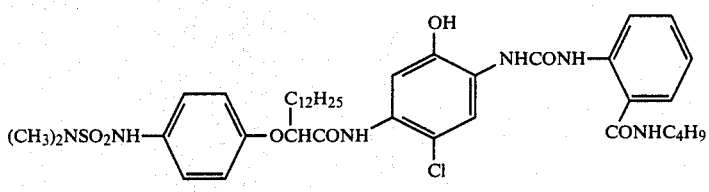
C-8
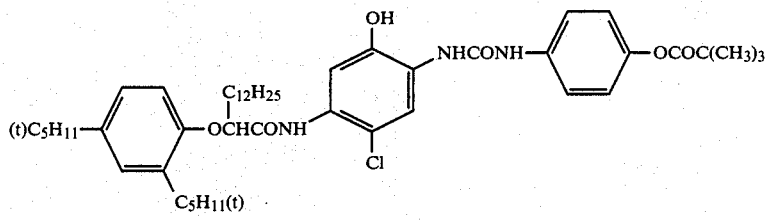
C-9
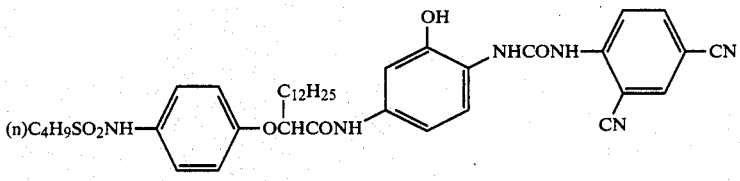
C-10
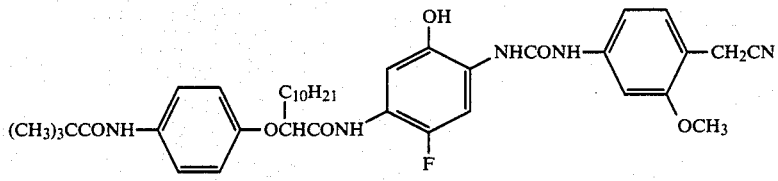
C-11
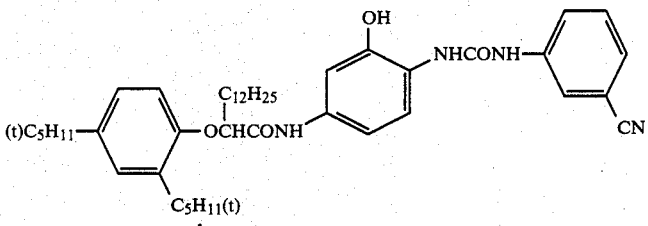
C-12
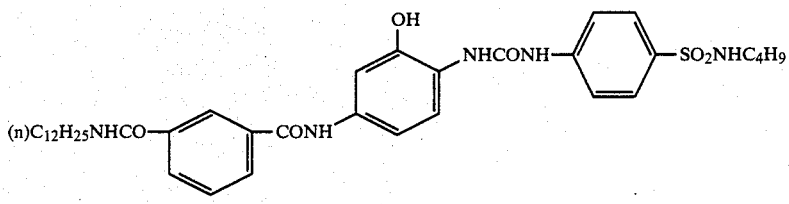
C-13
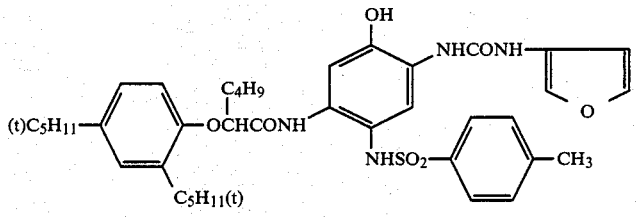
C-14
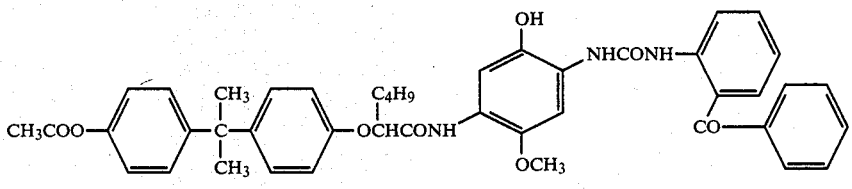

-continued
C-15
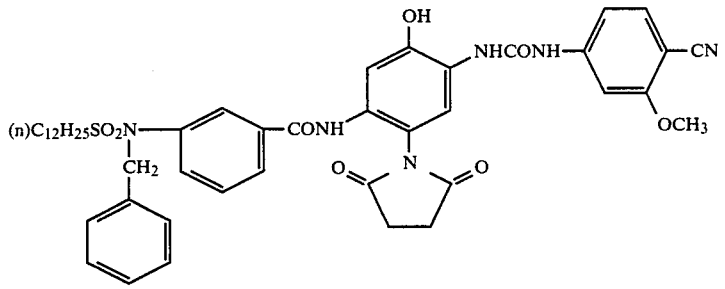
C-16
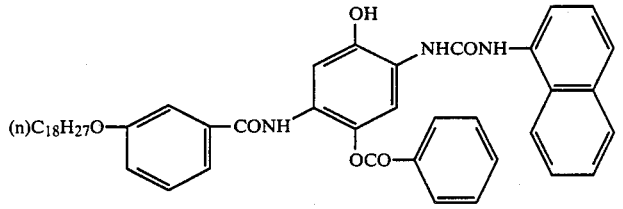
C-17
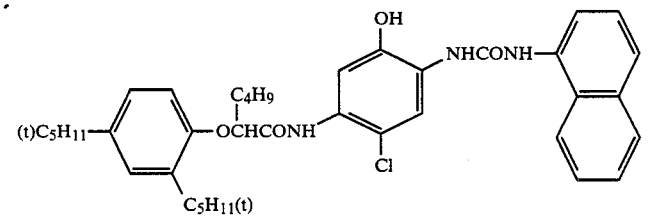
C-18
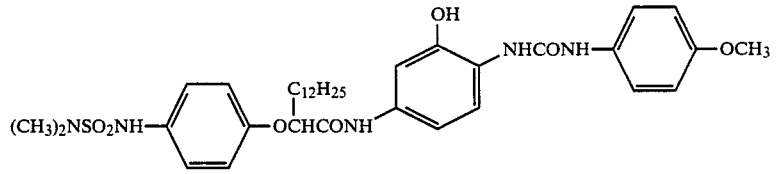
C-19
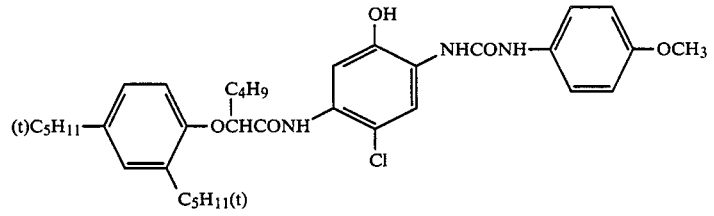
C-20
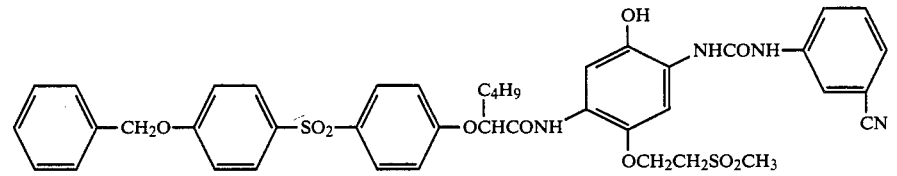

-continued
C-21
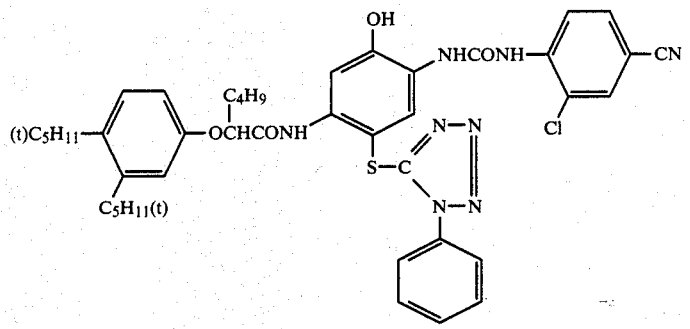
C-22
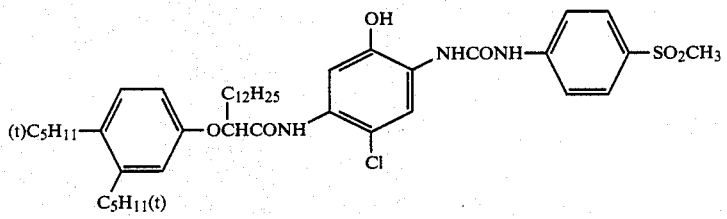
C-23
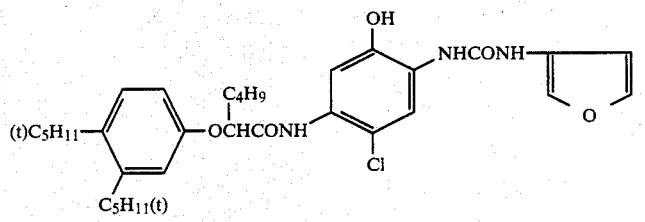
C-24
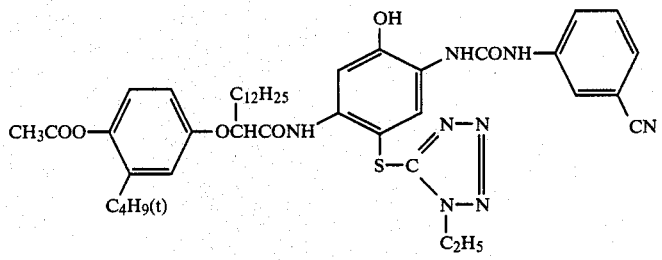
C-25
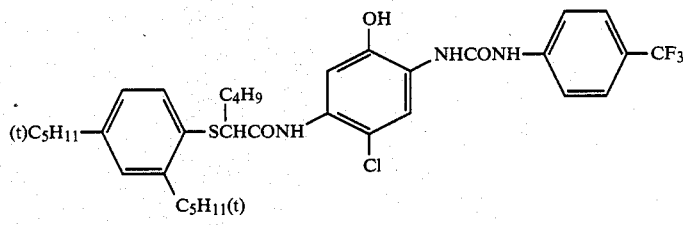
C-26
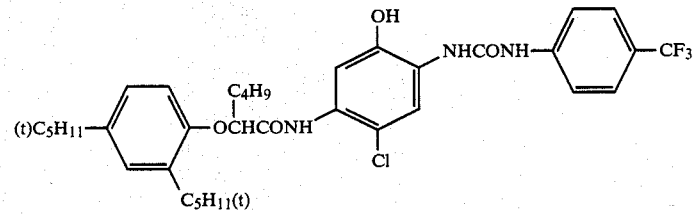

-continued
C-27
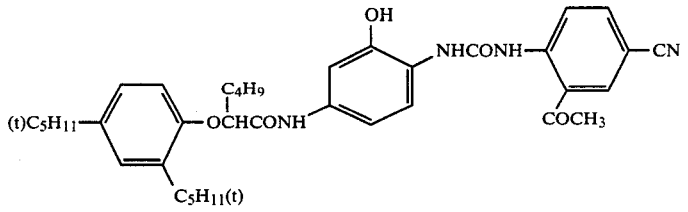
C-28
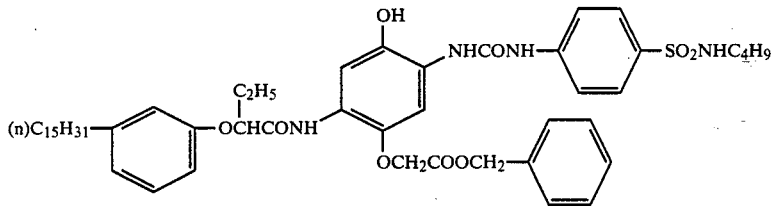
C-29
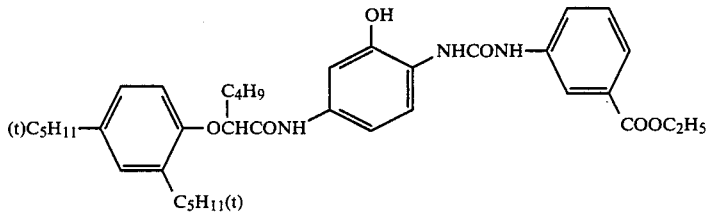
C-30
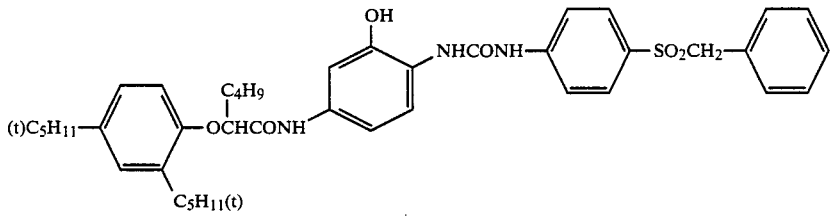
C-31
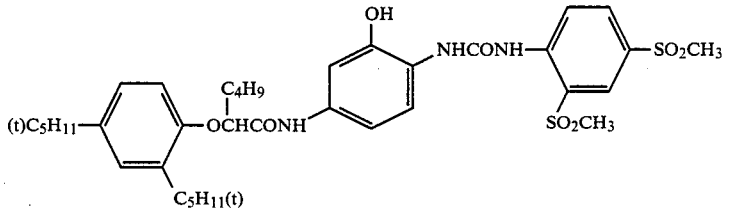
C-32
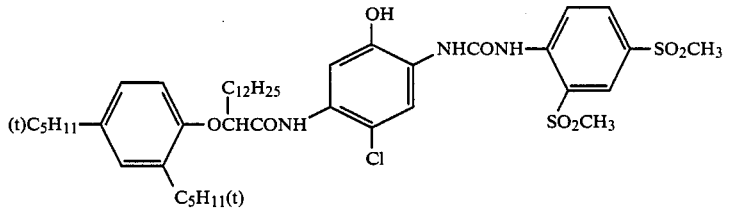
C-33
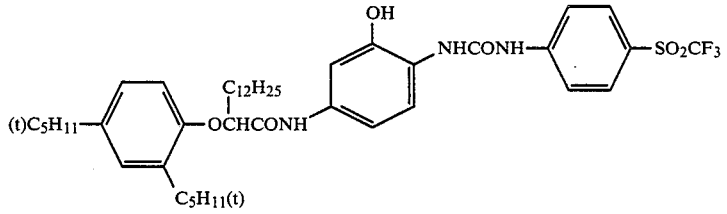

-continued
C-34
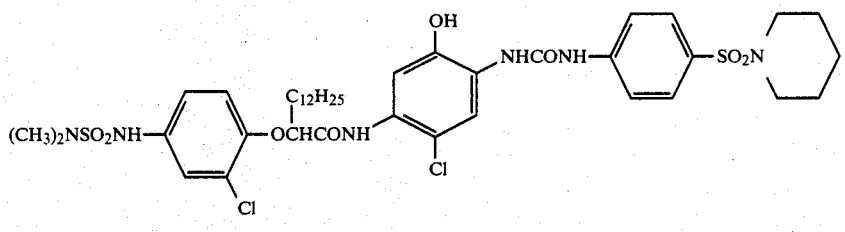
C-35
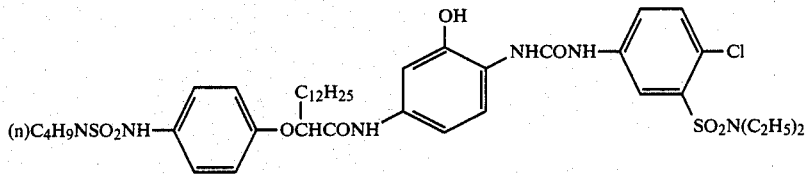
C-36
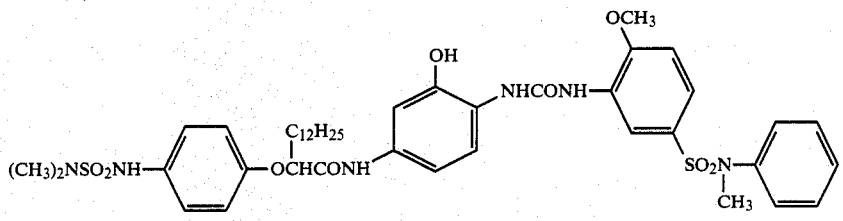
C-37
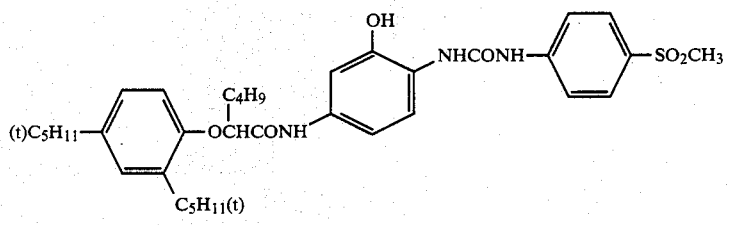
C-38
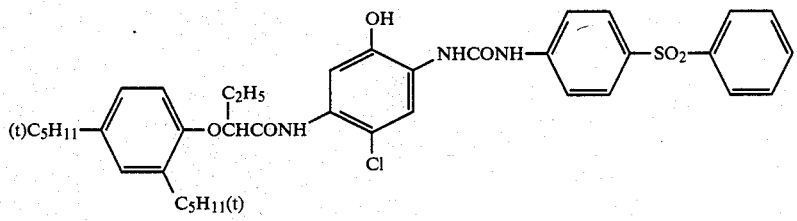
C-39
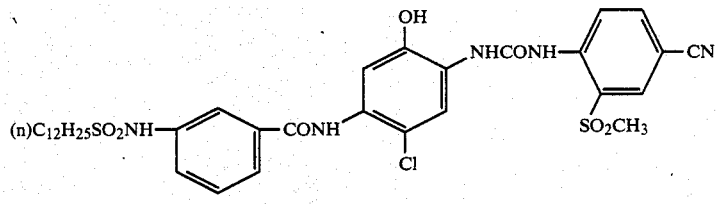
C-40
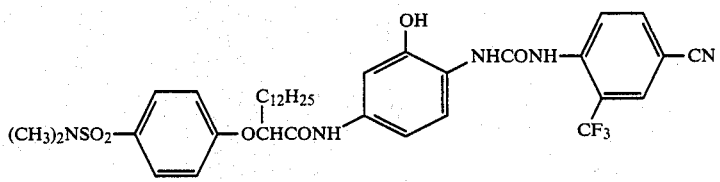

-continued
C-41
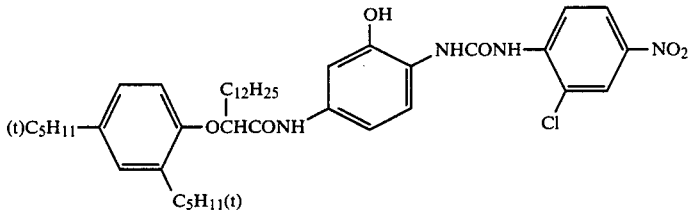
C-42
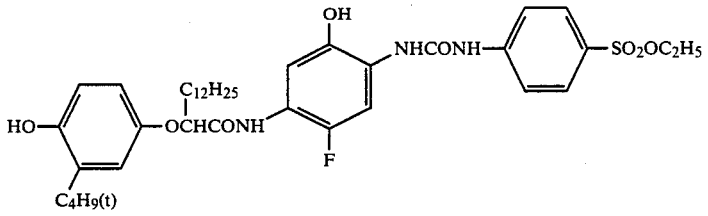
C-43
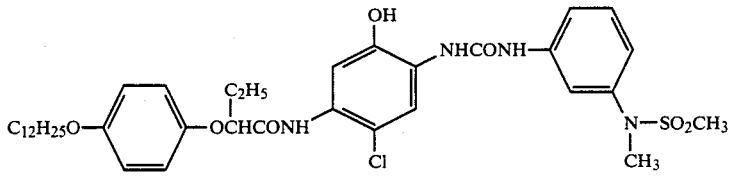
C-44
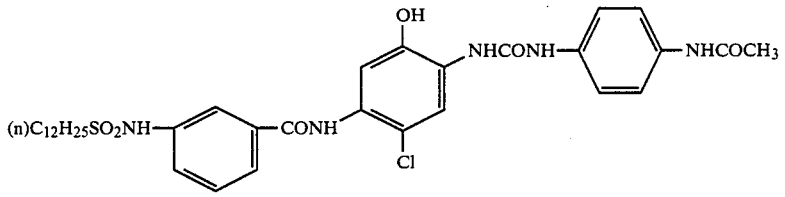
C-45
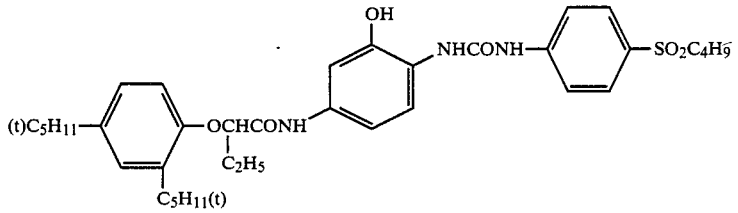
C-46
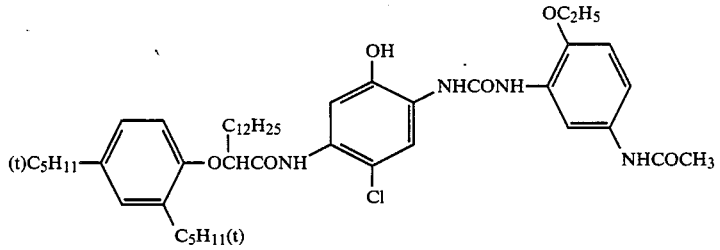
C-47
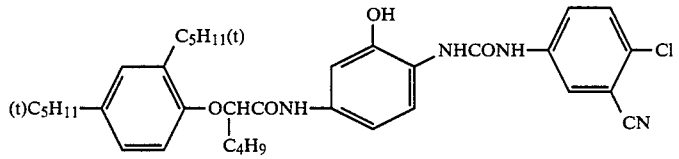

-continued
C-48
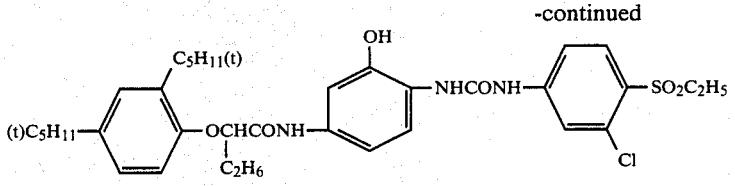
C-49
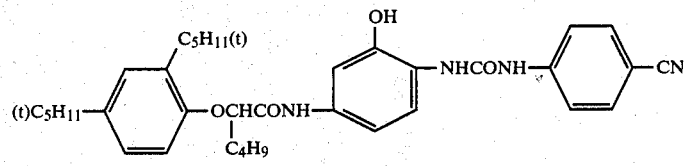
C-50
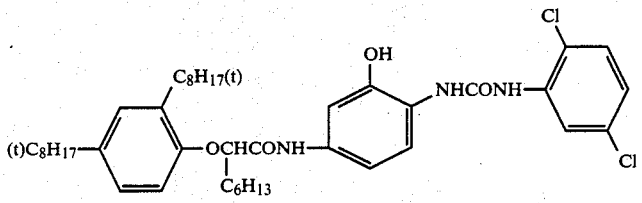
C-51
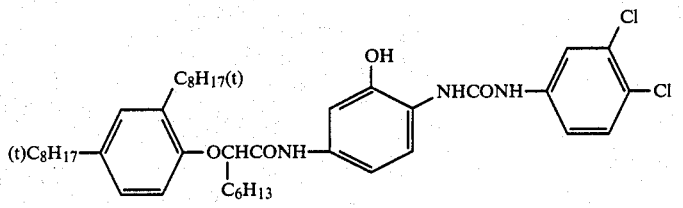
C-52
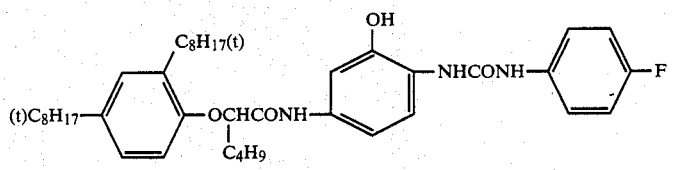
C-53
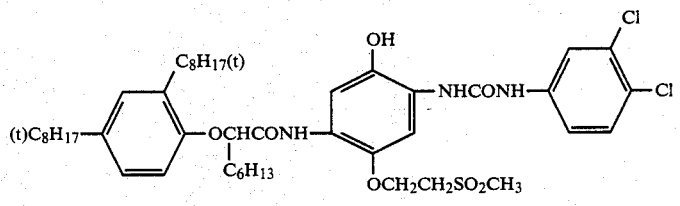
C-54
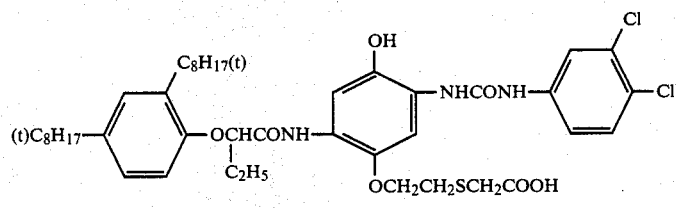
C-55
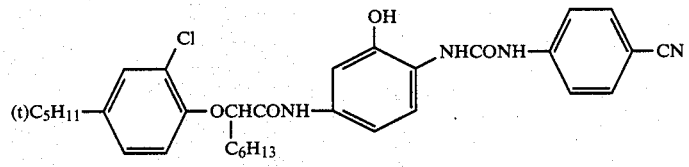
C-56
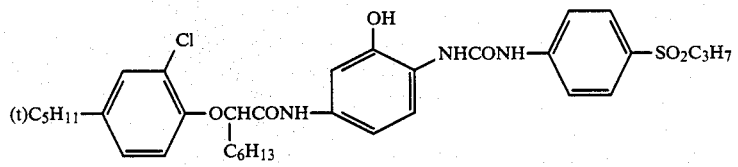

-continued

C-57

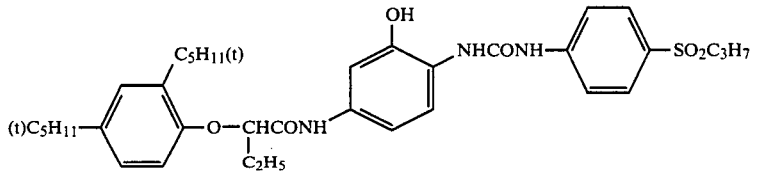

C-58

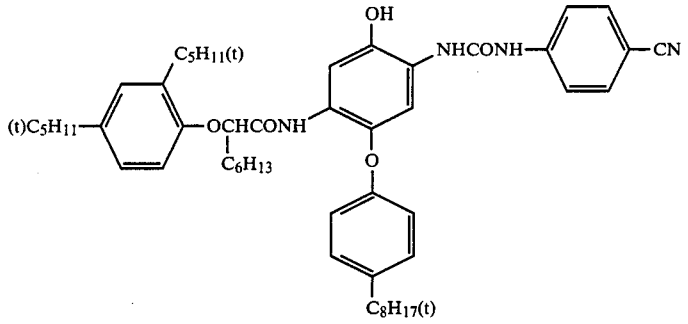

As for the binder for the core/shell-type silver halide grain of the present invention or the dispersing medium for use in the manufacture thereof, those hydrophilic colloids for ordinary silver halide emulsions may be used. Examples of the hydrophilic colloid include gelatin (subjected to either lime treatment or acid treatment), gelatin derivatives, those gelatin derivatives produced by the reaction of gelatin with an aromatic sulfonyl chloride, acid chloride, acid anhydride, isocyanate, or 1,4-diketones as described in, e.g., U.S. Pat. No. 2,614,928, those gelatin derivatives produced by the reaction of gelatin with trimellitic acid anhydride as described in U.S. Pat. No. 3,118,766, those gelatin derivatives obtained by the reaction of gelatin with an organic acid having an active halogen as those described in Japanese Patent Examined Publication No. 5514/1964, those gelatin derivatives produced by the reaction of gelatin with an aromatic glycidylether as described in Japanese Patent Examined Publication No. 26845/1967, those gelatin derivatives obtained by the reaction of gelatin with maleimide, maleamic acid, unsaturated aliphatic diamides, etc., as described in U.S. Pat. No. 3,186,846, those sulfoalkylated gelatins as described in British Pat. No. 1,033,189, those polyoxyalkylene derivatives as described in U.S. Pat. No. 3,312,553, and the like; high-molecular-grafted gelatin compounds such as those obtained by grafting onto gelatin, e.g., a single or combination of acrylic acid, methacrylic acid, esters thereof with a monohydric or polyhydric alcohol, amides, acrylic (methacrylic), etholylic, styrenic, and other vinyl-type monomers; synthetic hydrophilic high-molecular materials such as those homopolymers or copolymers comprising such monomers as vinyl alcohol, N-vinylpyrrolidone, hydroxyalkyl(meth)acrylate, (meth)acrylamide, N-substituted (meth)acrylamide, etc., those copolymers of methacrylic acid, vinyl acetate, styrene, etc., with these monomers, or those copolymers of maleic anhydride, maleamic acid, etc., with any of the above compounds; and the like. Those natural hydrophilic high-molecular materials other than gelatin, such as, e.g., casein, agar-agar, alginic acid, polysaccharides, etc., may also be used alone or in the form of a mixture.

The silver halide photographic emulsion containing the core/shell-type silver halide grain of the present invention may contain various additives which are generally used according to purposes; for example, stabilizers or antifoggants including azoles and imidazoles such as benzothiazolium salts, nitroinzoles, nitrobenzimidazoles, chlorobenzimidazoles, bromobenzimidazoles, mercaptothiazoles, mercaptobenzothiazoles, mercaptobenzimidazoles, mercaptothiadiazoles, triazoles such as aminotriazoles, benzotriazoles, nitrobenzotriazoles; tetrazoles such as mercaptotetrazoles (particularly 1-phenyl-5-mercaptotetrazole); mercaptopyrimidines; mercaptotriazines, e.g., thioketo compounds such as oxazolithione; azaindenes such as triazaindenes, tetraazaindenes (particularly 4-hydroxy-substituted (1,3,3a,7)tetraazaindenes), pentaazaindenes; benzenethiosulfonic acid, benzenesulfinic acid, benzenesulfonic acid amide, imidazolium salts, tetrazolium salts, polyhydroxy compounds, and the like.

The photographic light-sensitive material having the core/shell-type emulsion of this invention may contain in the photographic emulsion layers or other hydrophilic colloid layers thereof inorganic or organic hardening agents; for example, chromium salts (such as chrome alum, chromium acetate), aldehydes (such as formaldehyde, glyoxal, glutaraldehyde), N-methylol compounds (such as dimethylol-urea, methyloldimethylol-hydantoine), dioxane derivatives (such as 2,3-dihydroxydioxane), active vinyl compounds (such as 1,3,5,-triacryloyl-hexahydro-S-triazine, 1,3-vinylsulfonyl-2-propanol), active halogen compounds (such as 2,4-dichloro-6-hydroxy-S-triazine), mucohalogenic acids (such as mucochloric acid, mucophenoxychloric acid), and the like, may be used alone or in combination.

The photographic light-sensitive material which uses the core/shell-type emulsion of this invention may contain in the photographic emulsion layers or other hydrophilic colloide layers thereof water-insoluble or less-soluble synthetic polymer-dispersed additives for the purpose of improving the dimensional stability and the like of the light-sensitive material; for example, those polymers may be used which comprise alone or in combination such monomeric components as, e.g., alkyl(meth)acrylates, alkoxyalkyl(meth)acrylates, glycidyl(meth)acrylates, (meth)acrylamide, vinyl esters (such as vinyl acetate), acrylonitrile, olefins, styrenes, etc., or, together with these components, comprise alone or in combination such monomeric components as acrylic acid, methacrylic acid, $\alpha,\beta$-unsaturated dicarboxylic acid, hydroxyalkyl(meth)acrylates, sulfoalkyl(meth)acrylates, styrenesulfonic acid, and the like.

The silver halide photographic light-sensitive material of the present invention may, if necessary, contain a development accelerating agent such as benzyl alcohol, a polyoxyethylene-type compound, or the like; an image stabilizer such as a chroman-type, chraman-type, bisphenol-type or phosphite-type compound; a lubricant such as wax, a higher fatty acid glyceride, a higher alcohol ester of a higher fatty acid, or the like; a development control agent, a developing agent, a plasticizer, and/or a bleaching agent. Anionic, cationic, nonionic, or amphoteric surface active agents may be incorporated into the light-sensitive material as the coating aid, processing solution's permeability-improving agent, defoaming agent, or as the material for the control of various physical characteristics of the light-sensitive material. Alkaline salts of the reaction products of p-aminobenzenesulfonic acid with diacetyl cellulose, with styrene-perfluoroalkyl-sodium maleate copolymer, and with styrene-maleic anhydride copolymer, and the like, may be effectively used as the antistatic agent for the light-sensitive material. Examples of the matting agent for the light-sensitive material include polymethyl methacrylate, polystyrene, alkali-soluble polymers, and the like. Further, colloidal silicon oxide may also be used for the same purpose. Examples of the latex for use in improving the physical characteristics of the layers of the light-sensitive material include those polymers comprising such monomers as acrylic acid esters, vinyl esters, etc., with other ethylene-group-having monomers. Examples of the gelatin plasticizer include glycerol and glycol-type compounds. And examples of the viscosity-increasing agent include styrene-sodium maleate copolymer, alkyl-vinyl ether-maleic acid copolymers, and the like.

The emulsion having the silver halide grain of the present invention can possess an ample latitude by being comprised of a mixture of or being coated superposedly with at least two emulsions different in the average grain size or in the sensitivity.

In order to apply the core/shell-type silver halide emulsion of this invention to a photographic light-sensitive material for color photography use, those procedures and materials for color light-sensitive materials should be applied which are such that cyan, magenta and yellow couplers are incorporated in combination into the appropriate emulsions controlled to be red-sensitive, green-sensitive and blue-sensitive, containing the foregoing crystals of the present invention. Examples of the magenta coupler include 5-pyrazolone coupler, pyrazolobenzimidazole coupler, pyrazolotriazole coupler, cyanoacetylchroman coupler, open-chain acylacetonitrile coupler, and the like. Examples of the yellow coupler include acylacetamide couplers (such as benzoylacetanilides, pivaloylacetanilides), and the like. And examples of the cyan coupler other than those relating to the invention include naphthol couplers. The preferred ones of these couplers are those nondiffusible having hydrophobic groups called the ballasting group in the molecule thereof. These couplers may be allowed to be either four-equivalent or two-equivalent to silver ions. Also they can be either colored couplers having color-compensation effects or such couplers as releasing development inhibitors in the course of development (the so-called DIR coupler). Further, the light-sensitive material may also contain colorless DIR coupling agents, in addition to such DIR couplers, whose coupling reaction products are colorless and which release development inhibitors.

The red-sensitive silver halide emulsion to contain the cyan coupler of this invention may also contain cyan couplers and/or colored cyan couplers other than the cyan coupler of this invention, provided that such cyan couplers and/or colored cyan couplers are desirable to be contained in a quantity of less than 30% of the amount of the whole couplers.

Those cyan couplers usable in combination in the red-sensitive silver halide emulsion layers of this invention include phenol-type and naphthol-type compounds, concrete examples of which are described in U.S. Pat. Nos. 2,423,730, 2,474,293, 2,895,826, Japanese Patent O.P.I. Publication Nos. 117422/1975 and 82837/1982.

Those colored cyan couplers usable in combination in the red-sensitive silver halide emulsion layers of this invention include those as described in Japanese Patent Examined Publication No. 32461/1980, British Pat. No. 1,084,480, and the like.

The adding quantity of the cyan coupler of this invention and other couplers is preferably normally from $2\times10^{-3}$ to $5\times10^{-1}$ moles per mole of the silver in the emulsion layer, and more preferably from $1\times10^{-2}$ to $5\times10^{-1}$ moles. The incorporation of such couplers into the green-sensitive emulsion layer may be carried out through the use of the foregoing oil-protection dispersion or latex dispersion method, or otherwise through the use of an alkaline solution if such couplers are alkali-soluble.

The silver halide to be used in the present invention, although allowed to be a polydisperse emulsion of a wide-range average grain size distribution, is more desirable to be a monodisperse emulsion.

The preferred embodiment of the present invention is such that the monodisperse silver halide grains contained in at least one layer of the blue-sensitive silver halide emulsion layer, green-sensitive silver halide emulsion layer and red-sensitive silver halide emulsion layer may be a mixture of two or more types of grains, whose average grain sizes may be either the same or different. In this instance, polydisperse silver halide grains may also be used in combination.

As for the construction of the light-sensitive emulsion layers, the light-sensitive material of this invention can be of an orderly arranged emulsion layer construction, and may also be a reversely arranged emulsion layer construction (particularly as described in our Japanese Patent Application Nos. 193609/1984 and 202065/1984); significant effects can be obtained especially in the reversely arranged emulsion layer construction.

The respective silver halide emulsion layers of this invention each may be comprised of two or more separated layers different in the sensitivity; that is, from the further side toward the support side emulsions are put in the following order: (1) blue-sensitive silver halide high-sensitivity emulsion layer (BH), blue-sensitive silver halide low-sensitivity emulsion layer (BL), green-sensitive silver halide high-sensitivity emulsion layer (GH), green-sensitive silver halide low-sensitivity emulsion layer (GL), red-sensitive silver halide high-sensitivity emulsion layer (RH) and red-sensitive silver halide low-sensitivity emulsion layer, or (2) blue-sensitive silver halide high-sensitivity emulsion layer (BH), green-sensitive silver halide high-sensitivity emulsion layer (GH), red-sensitive silver halide high-sensitivity emulsion layer (RH), blue-sensitive silver halide low-sensitivity emulsion layer (BL), green-sensitive silver halide low-sensitivity emulsion layer (GL), and red-sensitive silver halide low-sensitivity emulsion layer. The average grain diameter (average grain size) of the silver halide contained in the blue-sensitive silver halide high-sensitivity emulsion layer (BH), green-sensitive silver halide high-sensitivity emulsion layer (GH) and red-sensitive silver halide high-sensitivity emulsion layer (RH) in the (1) and (2), particularly in the (2), is desirable to be from 0.40 to 3.00 μm, and more preferably from 0.50 to 2.50 μm.

The average grain diameter (average grain size) of the silver halide contained in the blue-sensitive silver halide low-sensitivity emulsion layer (BL), green-sensitive silver halide low-sensitivity emulsion layer (GL) and red-sensitive silver halide low-sensitivity emulsion layer (RL) in, e.g., the above (1) and (2), particularly in the (2), is desirable to be from 0.20 to 1.50 μm, and more preferably from 0.20 to 1.0 μm. If the blue-sensitive silver halide high-sensitivity emulsion layer (BL), green-sensitive silver halide low-sensitivity emulsion layer (GL) and red-sensitive silver halide low-sensitivity emulsion layer each is further divided into a medium-sensitivity layer and a low-sensitivity layer, the former being desirable to be from 0.30 to 1.50 μm, and the latter to be from 0.15 to 1.00 μm in the average grain size.

In practicing the present invention, the following antidiscoloration agents of the prior art may be used in combination, and color image stabilizers for this invention may also be used alone or in combination of two or more types of them. Examples of the known antidiscoloration agents include hydroquinone derivatives, gallic acid derivatives, p-alkoxyphenols, p-oxyphenol derivatives and bisphenols.

The light-sensitive material of this invention may contain in the hydrophilic colloid layers an ultraviolet absorbing agent, such as, e.g., an aryl group-substituted benzotriazole compound, 4-thiazolidone compound, benzophenone compound, cinnamic acid ester compound, butadiene compound, benzoxazole compound or further ultraviolet-absorbable polymer, or the like. Such ultraviolet absorbing agents may be fixed into the above-mentioned hydrophilic colloid layers.

The light-sensitive material of this invention may contain in the hydrophilic colloid layers thereof water-soluble dyes as the filter dye and/or anti-irradiation dye or for various other purposes. Those useful as such water-soluble dyes include oxonole dyes, hemioxonole dyes, styryl dyes, merocyanine dyes, cyanine dyes, and azo dyes. Above all, oxonole dyes, hemioxonole dyes and merocyanine dyes are useful.

The light-sensitive material of this invention may contain an anticolor stain agent, such as a hydroquinon derivative, aminophenol derivative, gallic acid derivative, ascorbic acid derivative, or the like.

The present invention is also applicable to a multilayered multicolor photographic material comprising at least two layers different in the spectral sensitivity. The multilayered color photographic material usually comprises a support having thereon at least one red-sensitive emulsion layer, one green-sensitive emulsion layer and one blue-sensitive emulsion layer. The order of these layers may, if necessary, be changed arbitrarily. In usual mannter, the red-sensitive emulsion layer contains a cyan color forming coupler, the green-sensitive emulsion layer contains a magenta color forming coupler, and the blue-sensitive emulsion layer contains an yellow color forming coupler, but, as the case may be, quite different combinations may be taken.

In the photographic light-sensitive material of this invention, the photographic emulsion layers and other hydrophilic colloid layers thereof may be coated on a support or on other layers in accordance with various known coating methods, such as the dip coating method, roller coating method, curtain coating method, extrusion coating method, or the like. Those methods as described in U.S. Pat. Nos. 2,681,294, 2,761,791 and 3,526,528 are advantageous.

Those materials usable as the support for the photographic light-sensitive material of this invention include baryta paper, polyethylene-coated paper, polypropylene synthetic paper, glass plates, cellulose acetate, cellulose nitrate, polyvinyl acetal, polypropylene, polyester film such as, e.g., polyethylene terephthalate, polystyrene, and the like, which are usually used for general photographic light-sensitive materials, and which should be arbitrarily selected to be used according to the purpose for which the light-sensitive material is used.

Such support materials may, if necessary, be subjected to subbing treatment.

Where the light-sensitive materials of the invention may be color-developed by any of those usually used color developing methods. In the reversal process, the light-sensitive material is first developed by a black-and-white developer liquid, then exposed to light or processed in a fogging agent-containing bath, and then color-developed by a color developing agent-containing alkaline developer solution.

As for the development, every processing method is applicable without limitation, but those processes representative of the color development include, e.g., a process wherein the light-sensitive material is color-developed, bleach-fixed, then, if necessary, washed, and then stabilized, and a process wherein the material is color-developed, then bleached and fixed separately, and then, if necessary, washed, and then further stabilized.

The color developer liquid is generally an aqueous alkaline solution containing a color developing agent. Examples of the usable color developing agent include known primary aromatic amin developing agents such as, for example, phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethylN-β-methanesulfoamidoethylaniline, 4-amino-3-methyl-N-ethyl-N-β-methoxyethylaniline, and the like.

In addition, those agents also are applicable which are described in L. F. A. Mason, 'Photographic Processing Chemistry' (Focal Press, 1966), p. 226~229, U.S. Pat. Nos. 2,193,015 and 2,592,364, Japanese Patent O.P.I. Publication No. 64933/1973, and the like.

The color developer solution may also contain additional pH buffer, development restrainer, antifoggant, and the like, and further may, if necessary, contain water softener, preservative, organic solvent, development accelerator, dye-forming couplers, competing couplers, fogging agent, auxiliary developing agent, viscosity-providing agent, polycarbonate-type chelating agent, oxidation inhibitor, and the like.

The photographic emulsion layers, after color development, are usually subjected to bleach treatment. The bleach treatment may take place either simultaneously with or separately from fixing treatment. Examples of the bleaching agent to be used in the bleach treatment include compounds of polyvalent metals such as iron (III), cobalt (IV), chromium (VI), copper (II), and the like, peroxides, quinones, nitroso compounds, and the like.

Into the bleaching bath or bleach-fix bath may be incorporated those thiol compounds as described in U.S. Pat. Nos. 3,042,520 and 3,241,966, Japanese Patent Examined Publication Nos. 8506/1970 and 8836/1970, and the like, and further may also be incorporated various other additives.

Subsequently, examples of the preparation of the silver halide grain of the present invention will be described in detail below:

PREPARATION EXAMPLE 1

(1-1) Preparation of Internal Core:

The following six different solutions were used to prepare a silver iodobromide emulsion EM-1 containing 4 mole% silver iodide.

| | |
|---|---|
| (Solution A-1) | |
| Osein gelatin | 39.7 g |
| Distilled water | 3936 ml |
| polyisopropylene-polyethyleneoxy-disuccinic acid ester sodium salt 10% ethanol solution | 3.54 ml |
| Magnesium sulfate | 3.6 g |
| 6% nitric acid | 75.6 ml |
| Potassium bromide | 2.06 g |
| (Solution B-1) | |
| Osein gelatin | 35.4 g |
| Potassium bromide | 807 g |
| Potassium iodide | 47 g |
| Polyisopropylene-polyethyleneoxy-disuccinic acid ester sodium salt 10% ethanol solution | 35.4 ml |
| Distilled water | 1432 ml |
| (Solution E-1) | |
| Silver nitrate | 1200 g |
| 6% nitric acid | 62 ml |
| Distilled water | 1467 ml |
| (Solution F-1) | |
| 25% KBr solution | Required q'ty for pAg adjustment |
| (Solution H-1) | |
| 6% nitric acid | Required q'ty for pH adjustment |
| (Solution I-1) | |
| 7% sodium carbonate solution | Required q'ty for pH adjustment |

To Solution A-1 were added Solutions E-1 and B-1 by the simultaneously mixing method at 40° C. with use of a mixing stirrer as shown in Japanese Patent O.P.I. Publication Nos. 92523/1982 and 92524/1982. The pAg, pH and addings speed of the solutions E-1 and B-1 during the simultaneous addition were controlled as shown in Table 1. The pAg and pH were controlled varying the flows of Solutions F-1 and H-1 by means of a flow-variable roller tube pump.

The pH was adjusted by Solution I-1 to 5.5 three minutes after completion of the addition of Solution E-1.

Subsequently, the resulting product was desalted and washed in usual manner, and then dispersed into an aqueous solution containing 125 g of Osein gelatin. Distilled water was added to make the whole amount 4800 ml.

The resulting emulsion was found out to be a monodisperse emulsion having an average grain diameter of 0.09 μm as a result of microscopic observation. The term 'grain diameter' used herein means the length of the side of a cube whose volume corresponds to that of the grain; the same shall apply hereinafter.

TABLE 1

| Time (min) | Rate of adding solution (ml/min) Solution E-1 | Solution B-1 | pAg | pH |
|---|---|---|---|---|
| 0.00 | 15.9 | 15.9 | 9.0 | 2.0 |
| 1.50 | 15.9 | 15.9 | 9.0 | 2.0 |
| 2.00 | 15.9 | 15.2 | 9.0 | 2.0 |
| 5.00 | 15.9 | 15.2 | 9.0 | 2.0 |
| 10.30 | 29.1 | 28.4 | 9.0 | 2.0 |
| 13.72 | 39.8 | 39.1 | 9.0 | 2.0 |
| 16.37 | 49.2 | 48.5 | 9.0 | 2.0 |
| 17.95 | 55.0 | 54.3 | 9.0 | 2.0 |
| 18.65 | 57.8 | 57.1 | 9.0 | 2.0 |
| 20.55 | 65.7 | 65.0 | 9.0 | 2.0 |
| 22.25 | 73.2 | 72.5 | 9.0 | 2.0 |
| 25.20 | 87.2 | 86.3 | 9.0 | 2.0 |
| 26.50 | 93.8 | 92.9 | 9.0 | 2.0 |
| 27.70 | 100.2 | 99.9 | 9.0 | 2.0 |
| 28.85 | 106.3 | 105.3 | 9.0 | 2.0 |
| 29.95 | 112.3 | 111.1 | 9.0 | 2.0 |
| 30.95 | 118.1 | 117.0 | 9.0 | 2.0 |
| 31.92 | 123.8 | 122.6 | 9.0 | 2.0 |
| 32.10 | 124.8 | 123.5 | 9.0 | 2.0 |

(1-2) Deposition of Fifth Shell:

The following five different solutions were used and the above EM-1 was used as a seed emulsion to thereby prepare an emulsion EM-2 having a 2 mole% silver iodide shell deposited onto the above internal core.

| | |
|---|---|
| (Solution A-2) | |
| Osein gelatin | 34.54 g |
| Distilled water | 8624 ml |
| Polyisopropylene-polyethyleneoxy disuccinic acid ester sodium salt 10% ethanol solution | 20 ml |
| 4-hydroxy-6-methyl-1,3,3a,7-tetraazaindene | 181.32 mg |
| 28% aqueous ammonia | 117.4 ml |
| 56% acetic acid solution | 154 ml |
| Magnesium sulfate | 16 g |
| Seed emulsion (EM-1) | 0.329 mole equivalent |
| (Solution B-2) | |
| Osein gelatin | 18.72 g |
| KBr | 763.8 g |
| KI | 21.8 g |
| 4-hydroxy-6-methyl-1,3,3a,7-tetrazaindene | 217 g |
| Magnesium sulfate | 7.4 g |
| Distilled water | 1578 ml |
| (Solution E-2) | |
| $AgNO_3$ | 1142.4 g |
| 28% aqueous ammonia | 931.4 ml |
| Add distilled water to make | 1921 ml |
| (Solution F-2) | |
| 50% KBr solution | Required q'ty for pAg adjustment |
| (Solution G-2) | |
| 56% acetic acid solution | Required q'ty for pH adjustment |

To Solution A-2 were added Solutions E-2 and B-2 at 40° C. by the simultaneously mixing method with use of a mixing stirrer as shown in Japanese Patent O.P.I. Publication Nos. 92523/1982 and 92524/1982 spending 32.5 minutes, the minimum time for allowing no occurrence of fine particles during the mixing. The pAg, pH and adding speeds of Solutions E-2 and B-2 in the course of the simultaneous mixing were controlled continuously as shown in Table 2. The pAg and pH were controlled with the flows of Solutions G-2 and B-2 being varied by a flow-varible roller tube pump.

The pAg was adjusted to 10.4 by Solution F-2 two minutes after completion of the addition of Solution E-2, and the pH was adjusted to 6.0 by Solution G-2 another two minutes thereafter.

TABLE 2

| Time (min) | Rate of adding solution (ml/min) Solution E-2 | Solution B-2 | pAg | pH |
|---|---|---|---|---|
| 0.00 | 16.24 | 15.44 | 8.50 | 8.00 |
| 5.43 | 41.87 | 40.15 | 8.54 | 7.95 |
| 8.17 | 60.36 | 58.69 | 8.58 | 7.88 |
| 10.88 | 76.58 | 74.98 | 8.64 | 7.78 |
| 13.62 | 83.78 | 82.24 | 8.71 | 7.66 |
| 16.33 | 81.82 | 80.33 | 8.78 | 7.53 |
| 19.07 | 75.04 | 73.56 | 8.84 | 7.42 |
| 21.78 | 66.98 | 65.53 | 8.90 | 7.31 |
| 24.51 | 59.36 | 57.93 | 8.95 | 7.22 |
| 26.83 | 53.65 | 51.93 | 8.99 | 7.15 |
| 29.97 | 49.56 | 47.82 | 9.00 | 7.06 |
| 32.48 | 46.47 | 44.71 | 9.00 | 7.00 |

Subsequently, the resulting product was desalted and washed in usual manner, and then dispersed into an aqueous solution containing 128.6 grams of Osein gelatin, and to this was added distilled water to make the whole 3000 ml. The resulting emulsion was found out to be as high-grade a mono disperse emulsion as having an average grain diameter of 0.27 μm and a grain size distribution's coefficient of variation of 12% as a result of microscopic observation.

(1-3) Deposition of Fourth Shell:

The following five different solutions were used and the above EM-2 was used as a seed emulsion to thereby prepare an emulsion EM-3 having silver iodobromide containing 2.6 mole% silver iodide deposited onto the above prepared shell.

| | |
|---|---|
| (Solution A-3) | |
| Osein gelatin | 34.0 g |
| Distilled water | 7779 ml |
| Polyisopropylene-polyethyleneoxy-disuccinic acid ester sodium salt 10% ethanol solution | 20 ml |
| 4-hydroxy-6-methyl-1,3,3a,7-tetraazaindene | 405 mg |
| 28% aqueous ammonia | 117.3 ml |
| 56% acetic acid solution | 72 ml |
| Seed emulsion (EM-2) | 0.303 mole equivalent |
| (Solution B-3) | |
| Osein gelatin | 18.74 g |
| KBr | 760.2 g |
| KI | 28.4 g |
| 4-hydroxy-6-methyl-1,3,3a,7-tetraazaindene | 1.35 g |
| Distilled water | 1574 ml |
| (Solution E-3) | |
| $AgNO_3$ | 1148 g |
| 28% aqueous ammonia | 937 ml |
| Add distilled water to make | 1930 ml |
| (Solution F-3) | |
| 50% KBr solution | Required q'ty for pAg adjustment |
| (Solution G-3) | |
| 50% acetic acid solution | Required q'ty for pH adjustment |

To Solution A-3 were added Solutions E-3 and B-3 simultaneously with use of a mixing stirrer as shown in Japanese Patent O.P.I. Publication Nos. 92523/1982 and 92524/1982 spending 56.5 minutes, the minimum time for allowing no occurrence of fine particles during the mixing. The controls of the pAg, pH and the adding speed of Solutions E-3 and B-3 during the simulataneous mixing were made as given in Table 3. The pAg and pH were controlled with the flows of Solutions F-3, G-3 and B-3 being varied by a flow-variable roller tube pump.

The pAg was adjusted to 10.4 by Solution F-3 two minutes after completion of the addition of Solution E-3, and the pH was adjusted to 6.0 by Solution G-3 another two minutes thereafter.

Subsequently, the resulting product was desalted and washed in usual manner, then dispersed into an aqueous solution containing 128.1 g of Osein gelatin, and then distilled water was added to make the whole 3000 ml.

The resulting emulsion was found out to be as high-grade a monodisperse emulsion as having an average grain diameter of 0.80 μm and a grain size distribution's coefficient of variation of 10% as a result of microscoping observation.

TABLE 3

| Time (min) | Rate of adding solution (ml/min) Solution E-3 | Solution B-3 | pAg | pH |
|---|---|---|---|---|
| 0.00 | 5.77 | 5.49 | 9.0 | 9.00 |
| 9.43 | 10.29 | 9.79 | 9.0 | 8.96 |
| 14.17 | 13.91 | 13.24 | 9.0 | 8.93 |
| 18.88 | 18.96 | 18.04 | 9.0 | 8.88 |
| 23.62 | 25.91 | 24.65 | 9.0 | 8.83 |
| 28.33 | 35.09 | 33.81 | 9.0 | 8.76 |
| 33.05 | 44.20 | 42.92 | 9.0 | 8.66 |
| 37.78 | 53.27 | 52.01 | 9.0 | 8.54 |
| 42.50 | 55.56 | 54.31 | 9.0 | 8.40 |
| 47.23 | 56.37 | 55.12 | 9.0 | 8.27 |
| 51.95 | 58.00 | 56.75 | 9.0 | 8.13 |
| 56.53 | 56.01 | 54.76 | 9.0 | 8.00 |

(1-4) Deposition of the High-Iodide Shell, Intermediate Shell and Outermost Shell of This Invention:

The following seven different solutions were used and the above EM-3 was used as a seed emulsion to thereby a high-iodide shell, intermediate shell and outermost shell-deposited emulsion EM-4 of the present invention was prepared.

| | |
|---|---|
| (Solution A-4) | |
| Osein gelatin | 22.5 g |
| Distilled water | 6884 ml |
| Polyisopropylene-polyethyleneoxy-disuccinic acid ester sodium salt 10% ethanol solution | 20 ml |
| 4-hydroxy-6-methyl-1,3,3a,7-tetraazaindene | Q'ty described in Table 4 |
| 28% aqueous ammonia | 469 ml |
| 56% acetic acid solution | 258 ml |
| Seed emulsion | 0.8828 mole equivalent |
| (Solution B-4) | |
| Osein gelatin | 24 g |
| KBr | Q'ty described in Table 5 |
| KI | Q'ty described in Table 5 |
| 4-hydroxy-6-methyl-1,3,3a,7-tetraazaindene | Q'ty described in Table 5 |
| Distilled water | 1978 ml |
| (Solution C-4) | |
| Osein gelatin | 24 g |
| KBr | Q'ty described in Table 6 |
| KI | Q'ty described in Table 6 |
| 4-hydroxy-6-methyl-1,3,3a,7-tetraazaindene | Q'ty described in Table 6 |

-continued

| | |
|---|---|
| Distilled water | 1978 ml |
| (Solution D-4) | |
| Osein gelatin | 40 g |
| KBr | Q'ty described in Table 7 |
| KI | Q'ty described in Table 7 |
| 4-hydroxy-6-methyl-1,3,3a,7-tetraazaindene | Q'ty described in Table 7 |
| Distilled water | 3296 ml |
| (Solution E-4) | |
| $AgNO_3$ | 1109 g |
| 28% aqueous ammonia | 904 ml |
| Add distilled water to make | 1866 ml |
| (Solution F-4) | |
| 50% KBr solution | Required q'ty for pAg adjustment |
| (Solution G-4) | |
| 56% acetic acid solution | Required q'ty for pH adjustment |

To Solution A-4 were added Solutions E-4 and B-4 simultaneously at 50° C. with use of a mixing stirrer as shown in Japanese Patent O.P.I. Publication Nos. 92523/1982 and 92524/1982 spending 46.6 minutes. Upon completion of the addition of Solution B-4 Solution C-4 was added, and 35.9 minutes later upon completion of the addition of Solution C-4 Solution D-4 was added, and the addition was completed 25.5 minutes layer. The pAg, pH and adding speeds of Solutions E-4, B-4, C-4 and D-4 during the simultaneous mixing were controlled as specified in Table 8. The controls of the pAg and pH were made varying the flows of Solutions F-4 and G-4 by a flow-variable roller tube pump.

The pAg was adjusted to 10.4 by Solution F-4 two minutes after completion of the addition of Solution E-4, and the pH was adjusted to 6.0 by Solution G-4 another two minutes thereafter.

Subsequently, the obtained product was desalted and washed in usual manner, then dispersed into an aqueous solution containing 127 g of Osein gelatin, and then distilled water was added to make the whole 3000 ml.

The thus obtained emulsion was found out to be as high-grade a monodisperse emulsion as having an average grain diameter of 1.60 μm and a grain size distribution's coefficient of variation of 11% as a result of microscopic observation.

The EM-4 is a core/shell-type silver iodobromide emulsion the respective shells' silver iodide contents of the grain of which are 15 mole%, 5 mole% and 0.3 mole% in the described order from the internal core of the grain (i.e., I=0.3, Ih=15 and Im-5).

TABLE 4

| Emulsion No. | Amount of Solution A-4 prepared: 4-hydroxy-6-methyl-1,3,3a,7-tetrazaindene (mg) |
|---|---|
| EM-4 | 646 |
| EM-5 | 646 |
| EM-6 | 646 |
| EM-7 | 646 |
| EM-8 | 646 |
| EM-9 | 646 |
| EM-10 | 646 |
| EM-11 | 646 |
| EM-12 | 646 |
| EM-13 | 646 |
| EM-14 | 646 |
| EM-15 | 646 |
| EM-16 | 646 |
| EM-17 | 646 |
| EM-18 | 646 |
| EM-19 | 646 |
| EM-20 | 646 |

TABLE 4-continued

| Emulsion No. | Amount of Solution A-4 prepared: 4-hydroxy-6-methyl-1,3,3a,7-tetrazaindene (mg) |
|---|---|
| EM-21 | 646 |
| EM-22 | 646 |
| EM-23 | 646 |
| EM-24 | 646 |
| EM-25 | 646 |
| EM-26 | 646 |
| EM-27 | 646 |
| EM-28 | 323 |
| EM-29 | 323 |
| EM-30 | 323 |
| EM-31 | 323 |
| EM-32 | 646 |
| EM-33 | 646 |
| EM-34 | 646 |
| EM-35 | 646 |
| EM-36 | 646 |
| EM-37 | 646 |
| EM-38 | 646 |
| EM-39 | 646 |

TABLE 5

| Emulsion No. | Amount of Solution B-4 prepared: 4-hydroxy-6-methyl-1,3,3a,7-tetrazaindene (mg) | KBr (g) | KI (g) | KI (KBr + KI) mol % |
|---|---|---|---|---|
| EM-4 | 2560 | 848 | 209 | 15 |
| EM-5 | 2560 | 848 | 209 | 15 |
| EM-6 | 2560 | 848 | 209 | 15 |
| EM-7 | 2560 | 848 | 209 | 15 |
| EM-8 | 2560 | 848 | 209 | 15 |
| EM-9 | 2560 | 848 | 209 | 15 |
| EM-10 | 2560 | 948 | 69.7 | 5 |
| EM-11 | 2560 | 918 | 111 | 8 |
| EM-12 | 2560 | 898 | 139 | 10 |
| EM-13 | 2560 | 798 | 278 | 20 |
| EM-14 | 2560 | 698 | 418 | 30 |
| EM-15 | 2560 | 598 | 557 | 40 |
| EM-16 | 2560 | 598 | 557 | 40 |
| EM-17 | 2560 | 498 | 697 | 50 |
| EM-18 | 2560 | 498 | 697 | 50 |
| EM-19 | 2560 | 848 | 209 | 15 |
| EM-20 | 2560 | 848 | 209 | 15 |
| EM-21 | 2560 | 848 | 209 | 15 |
| EM-22 | 2560 | 848 | 209 | 15 |
| EM-23 | 2560 | 848 | 209 | 15 |
| EM-24 | 2560 | 848 | 209 | 15 |
| EM-25 | 2560 | 848 | 209 | 15 |
| EM-26 | 2560 | 748 | 348 | 25 |
| EM-27 | 2560 | 848 | 209 | 15 |
| EM-28 | 1280 | 848 | 209 | 15 |
| EM-29 | 1280 | 848 | 209 | 15 |
| EM-30 | 1280 | 848 | 209 | 15 |
| EM-31 | 1280 | 848 | 209 | 15 |
| EM-32 | 2560 | 848 | 209 | 15 |
| EM-33 | 2560 | 848 | 209 | 15 |
| EM-34 | 2560 | 848 | 209 | 15 |
| EM-35 | 2560 | 748 | 348 | 25 |
| EM-36 | 2560 | 648 | 488 | 35 |
| EM-37 | 2560 | 648 | 488 | 35 |
| EM-38 | 2560 | 918 | 111 | 8 |
| EM-39 | 2560 | 918 | 111 | 8 |

TABLE 6

| Emulsion No. | Amount of Solution C-4 prepared: 4-hydroxy-6-methyl-1,3,3a,7-tetrazaindene (mg) | KBr (g) | KI (g) | KI (KBr + KI) mol % |
|---|---|---|---|---|
| EM-4 | 2560 | 948 | 69.7 | 5 |
| EM-5 | 2560 | 848 | 209 | 15 |
| EM-6 | 2560 | 868 | 181 | 13 |
| EM-7 | 2560 | 898 | 139 | 10 |
| EM-8 | 2560 | 978 | 27.9 | 2 |

TABLE 6-continued

| Emulsion No. | Amount of Solution C-4 prepared: 4-hydroxy-6-methyl-1,3,3a,7-tetra-zaindene (mg) | KBr (g) | KI (g) | KI/(KBr + KI) mol % |
|---|---|---|---|---|
| EM-9 | 2560 | 996 | 4.18 | 0.3 |
| EM-10 | 2560 | 948 | 69.7 | 5 |
| EM-11 | 2560 | 948 | 69.7 | 5 |
| EM-12 | 2560 | 948 | 69.7 | 5 |
| EM-13 | 2560 | 948 | 69.7 | 5 |
| EM-14 | 2560 | 948 | 69.7 | 5 |
| EM-15 | 2560 | 948 | 69.7 | 5 |
| EM-16 | 2560 | 996 | 4.18 | 0.3 |
| EM-17 | 2560 | 948 | 69.7 | 5 |
| EM-18 | 2560 | 996 | 4.18 | 0.3 |
| EM-19 | 2560 | 948 | 69.7 | 5 |
| EM-20 | 2560 | 948 | 69.7 | 5 |
| EM-21 | 2560 | 948 | 69.7 | 5 |
| EM-22 | 2560 | 948 | 69.7 | 5 |
| EM-23 | 2560 | 898 | 139 | 10 |
| EM-24 | 2560 | 898 | 139 | 10 |
| EM-25 | 2560 | 898 | 139 | 10 |
| EM-26 | 2560 | 828 | 237 | 17 |
| EM-27 | 2560 | 948 | 69.7 | 5 |
| EM-28 | 1280 | 948 | 69.7 | 5 |
| EM-29 | 1280 | 996 | 4.18 | 0.3 |
| EM-30 | 1280 | 948 | 69.7 | 5 |
| EM-31 | 1280 | 996 | 4.18 | 0.3 |
| EM-32 | 2560 | 948 | 69.7 | 5 |
| EM-33 | 2560 | 948 | 69.7 | 5 |
| EM-34 | 2560 | 948 | 69.7 | 5 |
| EM-35 | 2560 | 898 | 139 | 10 |
| EM-36 | 2560 | 898 | 139 | 10 |
| EM-37 | 2560 | 924 | 104 | 7.5 |
| EM-38 | 2560 | 956 | 55.7 | 4 |
| EM-31 | 2560 | 996 | 4.18 | 0.3 |

TABLE 7

| Emulsion No. | Amount of Solution D-4 prepared: 4-hydroxy-6-methyl-1,3,3a,7-tetra-zaindene (mg) | KBr (g) | KI (g) | KI/(KBr + KI) mol % |
|---|---|---|---|---|
| EM-4 | -4268 | 1660 | 6.97 | 0.3 |
| EM-5 | 4268 | 1660 | 6.97 | 0.3 |
| EM-6 | 4268 | 1660 | 6.97 | 0.3 |
| EM-7 | 4268 | 1660 | 6.97 | 0.3 |
| EM-8 | 4268 | 1660 | 6.97 | 0.3 |
| EM-9 | 4268 | 1660 | 6.97 | 0.3 |
| EM-10 | 4268 | 1660 | 6.97 | 0.3 |
| EM-11 | 4268 | 1660 | 6.97 | 0.3 |
| EM-12 | 4268 | 1660 | 6.97 | 0.3 |
| EM-13 | 4268 | 1660 | 6.97 | 0.3 |
| EM-14 | 4268 | 1660 | 6.97 | 0.3 |
| EM-15 | 4268 | 1660 | 6.97 | 0.3 |
| EM-16 | 4268 | 1660 | 6.97 | 0.3 |
| EM-17 | 4268 | 1660 | 6.97 | 0.3 |
| EM-18 | 4268 | 1660 | 6.97 | 0.3 |
| EM-19 | 4268 | 1660 | 0 | 0 |
| EM-20 | 4268 | 1657 | 11.6 | 0.5 |
| EM-21 | 4268 | 1641 | 34.8 | 1.5 |
| EM-22 | 4268 | 1591 | 104 | 4.5 |
| EM-23 | 4268 | 1641 | 34.8 | 1.5 |
| EM-24 | 4268 | 1591 | 104 | 4.5 |
| EM-25 | 4268 | 1532 | 185 | 8 |
| EM-26 | 4268 | 1482 | 255 | 11 |
| EM-27 | 4268 | 1660 | 6.97 | 0.3 |
| EM-28 | 2134 | 1660 | 6.97 | 0.3 |
| EM-29 | 2134 | 1660 | 6.97 | 0.3 |
| EM-30 | 2134 | 1660 | 6.97 | 0.3 |
| EM-31 | 2134 | 1660 | 6.97 | 0.3 |
| EM-32 | 4268 | 1660 | 6.97 | 0.3 |
| EM-33 | 4268 | 1660 | 6.97 | 0.3 |
| EM-34 | 4268 | 1660 | 6.97 | 0.3 |
| EM-35 | 4268 | 1581 | 115 | 5 |
| EM-36 | 4268 | 1581 | 115 | 5 |
| EM-37 | 4268 | 1581 | 115 | 5 |
| EM-38 | 4268 | 1660 | 6.97 | 0.3 |
| EM-39 | 4268 | 1660 | 6.97 | 0.3 |

TABLE 8

| Time (min) | Rate of adding solution (ml/min): E-4 | B-4 | C-4 | D-4 | pAg | pH |
|---|---|---|---|---|---|---|
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 36.00 | 10.55 | 10.45 | — | — | 8.70 | 9.00 |
| 45.00 | 11.29 | 11.18 | — | — | 8.70 | 9.00 |
| 46.60 | 11.51 | 11.40 | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

PREPARATION EXAMPLE 2

Emulsions EM-5, EM-6, EM-7, EM-8 and EM-9 were prepared using the seven solutions given in the (1-4) of Preparation Example 1 in the same manner as in the (1-4) of Preparation Example 1 except that the adding quantities of the KBr, KI and 4-hydroxy-6-methyl-1,3,3a,7-tetraazaindene were settled as specified in Tables 4, 5, 6 and 7.

These obtained emulsions were monodisperse emulsions each having an average grain diameter of 1.60 μm, and the coefficients of variation of the grain size distributions of the emulsions were 17%, 15%, 12%, 16% and 16%, respectively.

PREPARATION EXAMPLE 3

Emulsions EM-10 through EM-26 were prepared using the seven solutions given in the (1-4) of Preparation Example 1 in the same manner as in the (1-4) of Preparation Example 1 except that the preparation quantities of the KBr, KI and 4-hydroxy-6-methyl-1,3,3a,7-tetraazaindene were settled as specified in Tables 4, 5, 6 and 7.

These obtained emulsions were monodisperse emulsions each having an average grain diameter of 1.60 μm, and the coefficients of variation in the grain size distributions of these emulsions were 10%, 10%, 11%, 12%, 13%, 18%, 19%, 35%, 39%, 10%, 11%, 11%, 11%, 12%, 12%, 12% and 13%, respectively.

PREPARATION EXAMPLE 4

Emulsions EM-28 and EM-29 were prepared using the seven solutions given in the (1-4) of Preparation Example 1 in the same manner as in the (1-4) of Preparation Example 1 except that the preparation quantities of the KBr, KI and 4-hydroxy-6-methyl-1,3,3a,7-tetraazaindene were settled as specified in Tables 4, 5, 6 and 7.

Further, the controls of the pAg, pH and adding speeds of E-4, B-4, C-4 and D-4 during the mixing were varied as shown in Table 9 to thereby prepare Emulsion E-27, and also varied as shown in Table 10 to thereby prepare Emulsions EM-30 and EM-31.

These obtained emulsions were monodisperse emulsions each having an average grain diameter of 1.6 μm, and the coefficients of variation of the grain size distributions of the emulsions were 9%, 18%, 19%, 32% and 34%, respectively.

TABLE 9

| Time (min) | Rate of adding solution (ml/min) E-4 | B-4 | C-4 | D-4 | pAg | pH |
|---|---|---|---|---|---|---|
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 36.00 | 10.55 | 10.45 | — | — | 8.70 | 9.00 |
| 45.00 | 11.29 | 11.18 | — | — | 8.70 | 9.00 |
| 46.60 | 11.51 | 11.40 | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.00 | 8.21 |
| 82.50 | 24.12 | — | 23.88 | 23.88 | 10.00 | 8.04 |
| 90.06 | 21.89 | — | — | 21.67 | 10.00 | 7.86 |
| 99.08 | 20.13 | — | — | 19.93 | 10.00 | 7.66 |
| 108.00 | 19.25 | — | — | 19.06 | 10.00 | 7.50 |

TABLE 10

| Time (min) | Rate of adding solution (ml/min) E-4 | B-4 | C-4 | D-4 | pAg | pH |
|---|---|---|---|---|---|---|
| 0.00 | 7.07 | 7.00 | — | — | 10.20 | 9.00 |
| 18.00 | 8.89 | 8.80 | — | — | 10.20 | 9.00* |
| 27.00 | 9.75 | 9.65 | — | — | 10.20 | 9.00 |
| 36.00 | 10.55 | 10.45 | — | — | 10.20 | 9.00 |
| 45.00 | 11.29 | 11.18 | — | — | 10.20 | 9.00 |
| 46.60 | 11.51 | 11.40 | 11.40 | — | 10.20 | 9.00 |
| 54.80 | 16.44 | — | 18.12 | — | 10.20 | 8.86 |
| 63.05 | 21.38 | — | 24.73 | — | 10.20 | 8.66 |
| 72.05 | 32.84 | — | 60.87 | — | 10.20 | 8.31 |
| 75.50 | 26.31 | — | 54.69 | — | 10.20 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

PREPARATION EXAMPLE 5

The seven solutions given in the (1-4) of Preparation Example 1 were used with the KBr, KI and 4-hydroxy-6-methyl-1,3,3a,7-tetraazaindene in the preparation quantities specified in Tables 4, 5, 6 and 7 and with the pAg, pH and adding speeds of E-4, B-4, C-4 and D-4 during the mixing controlled as shown in Table 11 to thereby prepared Emulsion EM-22 and also controlled as shown in Table 12 to thereby prepare Emulsion EM-33 and further controlled as shown in Table 13 to thereby prepare Emulsion EM-34.

These obtained emulsions were monodisperse emulsions each having an average grain diameter of 1.6 μm and the coefficients of variation of the grain size distributions of them were 10%, 10% and 12%, respectively.

TABLE 11

| Time (min) | Rate of adding solution (ml/min) E-4 | B-4 | C-4 | D-4 | pAg | pH |
|---|---|---|---|---|---|---|
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 28.50 | 9.89 | 9.80 | 9.80 | — | 8.70 | 9.00 |
| 36.00 | 10.55 | — | 10.45 | — | 8.70 | 9.00 |
| 45.00 | 11.29 | — | 11.18 | — | 8.70 | 9.00 |
| 46.60 | 11.51 | | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.19 | 8.21 |

TABLE 11-continued

| Time (min) | Rate of adding solution (ml/min) E-4 | B-4 | C-4 | D-4 | pAg | pH |
|---|---|---|---|---|---|---|
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

TABLE 12

| Time (min) | Rate of adding solution (ml/min) E-4 | B-4 | C-4 | D-4 | pAg | pH |
|---|---|---|---|---|---|---|
| 0.00 | 7.07 | 7.00 | — | — | 8.70 | 9.00 |
| 13.90 | 8.47 | 8.39 | 8.39 | — | 8.70 | 9.00 |
| 18.00 | 9.75 | — | 9.65 | — | 8.70 | 9.00 |
| 27.00 | 9.89 | — | 9.80 | — | 8.70 | 9.00 |
| 36.00 | 10.55 | — | 10.45 | — | 8.70 | 9.00 |
| 45.00 | 11.29 | — | 11.18 | — | 8.70 | 9.00 |
| 46.60 | 11.51 | — | 11.40 | — | 8.70 | 9.00 |
| 54.80 | 16.44 | — | 18.12 | — | 8.93 | 8.86 |
| 63.05 | 21.38 | — | 24.73 | — | 9.30 | 8.66 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

TABLE 13

| Time (min) | Rate of adding solution (ml/min) E-4 | B-4 | C-4 | D-4 | pAg | pH |
|---|---|---|---|---|---|---|
| 0.00 | 7.07 | 7.00 | — | — | 8.70 | 9.00 |
| 18.00 | 8.89 | 8.80 | — | — | 8.70 | 9.00 |
| 27.00 | 9.75 | 9.65 | — | — | 8.70 | 9.00 |
| 36.00 | 10.55 | 10.45 | — | — | 8.70 | 9.00 |
| 45.00 | 11.29 | 11.18 | — | — | 8.70 | 9.00 |
| 46.60 | 11.51 | 11.40 | — | — | 8.70 | 9.00 |
| 54.80 | 16.44 | 18.12 | — | — | 8.93 | 8.86 |
| 63.05 | 21.38 | 24.73 | — | — | 9.30 | 8.66 |
| 68.85 | 28.76 | 48.02 | 48.02 | — | 9.72 | 8.43 |
| 72.05 | 32.84 | — | 60.87 | — | 9.96 | 8.31 |
| 75.50 | 26.31 | — | 54.69 | — | 10.19 | 8.21 |
| 82.50 | 24.12 | — | 23.88 | 23.88 | 10.20 | 8.04 |
| 90.06 | 21.89 | — | — | 21.67 | 10.20 | 7.86 |
| 99.08 | 20.13 | — | — | 19.93 | 10.20 | 7.66 |
| 108.00 | 19.25 | — | — | 19.06 | 10.20 | 7.50 |

PREPARATION EXAMPLE 6

Emulsions EMs-35, -36 and -37 were prepared using the seven solutions given in the (1-4) of Preparation Example 1 in the same manner as in the (1-4) of Preparation Example 1 except that the preparation quantities of the KBr, KI and 4-hydroxy-6-methyl-1,3,3*a*,7-tetraazaindene were settled as specified in Table 4, 5, 6 and 7.

Further, the controls of the pAg, pH and adding speeds of E-4, B-4, C-4 and D-4 during the mixing were varied as shown in Table 12 to thereby prepare Emulsions EM-38 and EM-39.

These emulsions are monodisperse emulsions each having an average grain diameter of 1.6 μm, and the coefficients of variation of the grain size distributions of the emulsions were 12%, 14%, 13%, 9% and 11%, respectively.

Subsequently, the composition of the above-described emulsions will ge given in Tables-14 through 19.

TABLE 14

| EM-No. | Ih mol % | Im mol % | Il mol % | ΔI = Ih − Il mol % | ΔIh = Ih − Im mol % | ΔIl = Im − Il mol % | Aggregate amount of iodide % | Volume of each shell Vh % | Vm % | Vl % | Veriation coeffi-cient % |
|---|---|---|---|---|---|---|---|---|---|---|---|
| EM-5 (Other than Invention) | 15 | 15 | 0.3 | 14.7 | 0 | 14.7 | 9.5 | 22 | 39 | 27 | 17 |
| EM-6 (Other than Invention) | 15 | 13 | 0.3 | 14.7 | 2 | 12.7 | 8.7 | 22 | 39 | 27 | 15 |
| EM-7 (Invention) | 15 | 10 | 0.3 | 14.7 | 5 | 9.7 | 7.5 | 22 | 39 | 27 | 12 |
| EM-4 (Invention) | 15 | 5 | 0.3 | 14.7 | 10 | 4.7 | 5.6 | 22 | 39 | 27 | 11 |
| EM-8 (Other than Invention) | 15 | 2 | 0.3 | 14.7 | 13 | 1.7 | 4.4 | 22 | 39 | 27 | 16 |
| EM-9 (Other than Invention) | 15 | 0.3 | 0.3 | 14.7 | 14.7 | 0 | 3.8 | 22 | 39 | 27 | 16 |

TABLE 15

| EM-No. | Ih mol % | Im mol % | Il mol % | ΔI = Ih − Il mol % | ΔIh = Ih − Im mol % | ΔIl = Im − Il mol % | Aggregate amount of iodide % | Volume of each shell Vh % | Vm % | Vl % | Variation coefficient % |
|---|---|---|---|---|---|---|---|---|---|---|---|
| EM-5 (Other than Invention) | 15 | 15 | 0.3 | 14.7 | 0 | 14.7 | 9.5 | 22 | 39 | 27 | 17 |
| EM-9 (Other than Invention) | 15 | 0.3 | 0.3 | 14.7 | 14.7 | 0 | 3.8 | 22 | 39 | 27 | 16 |
| EM-10 (Other than Invention) | 5 | 5 | 0.3 | 4.7 | 0 | 4.7 | 3.4 | 22 | 39 | 27 | 10 |
| EM-11 (Invention) | 8 | 5 | 0.3 | 7.7 | 3 | 4.7 | 4.1 | 22 | 39 | 27 | 10 |
| EM-12 (Invention) | 10 | 5 | 0.3 | 9.7 | 5 | 4.7 | 4.5 | 22 | 39 | 27 | 11 |
| EM-4 (Invention) | 15 | 5 | 0.3 | 14.7 | 10 | 4.7 | 5.6 | 22 | 39 | 27 | 11 |
| EM-13 (Invention) | 20 | 5 | 0.3 | 19.7 | 15 | 4.7 | 6.7 | 22 | 39 | 27 | 12 |
| EM-14 (Invention) | 30 | 5 | 0.3 | 29.7 | 25 | 4.7 | 8.8 | 22 | 39 | 27 | 13 |
| EM-15 (Invention) | 40 | 5 | 0.3 | 39.7 | 35 | 4.7 | 11.1 | 22 | 39 | 27 | 18 |
| EM-16 (Other than Invention) | 40 | 0.3 | 0.3 | 39.7 | 39.7 | 0 | 9.2 | 22 | 39 | 27 | 19 |
| EM-17 (Invention) | 50 | 5 | 0.3 | 49.7 | 45 | 4.7 | 12.2 | 22 | 39 | 27 | 35 |
| EM-18 (Other than Invention) | 50 | 0.3 | 0.3 | 49.7 | 49.7 | 0 | 11.4 | 22 | 39 | 27 | 39 |

TABLE 16

| EM-No. | Ih mol % | Im mol % | Il mol % | ΔI = Ih − Il mol % | ΔIh = Ih − Im mol % | ΔIl = Im − Il mol % | Aggregate amount of iodide % | Volume of each shell Vh % | Vm % | Vl % | Variation coefficient % |
|---|---|---|---|---|---|---|---|---|---|---|---|
| EM-5 (Other than Invention) | 15 | 15 | 0.3 | 14.7 | 0 | 14.7 | 9.5 | 22 | 39 | 27 | 17 |
| EM-9 (Other than invention) | 15 | 0.3 | 0.3 | 14.7 | 14.7 | 0 | 3.8 | 22 | 39 | 27 | 16 |
| EM-19 (Invention) | 15 | 5 | 0 | 15 | 10 | 5 | 5.5 | 22 | 39 | 27 | 10 |
| EM-4 (Invention) | 15 | 5 | 0.3 | 14.7 | 10 | 4.7 | 5.6 | 22 | 39 | 27 | 11 |
| EM-20 (Invention) | 15 | 5 | 0.5 | 14.5 | 10 | 4.5 | 5.7 | 22 | 39 | 27 | 11 |
| EM-21 (Invention) | 15 | 5 | 1.5 | 13.5 | 10 | 3.5 | 5.9 | 22 | 39 | 27 | 11 |
| EM-22 (Other than | 15 | 5 | 4.5 | 10.5 | 10 | 0.5 | 6.7 | 22 | 39 | 27 | 11 |

TABLE 16-continued

| EM-No. | Ih mol % | Im mol % | Il mol % | ΔI = Ih − Il mol % | ΔIh = Ih − Im mol % | ΔIl = Im − Il mol % | Aggregate amount of iodide % | Volume of each shell Vh % | Vm % | Vl % | Variation coefficient % |
|---|---|---|---|---|---|---|---|---|---|---|---|
| Invention) | | | | | | | | | | | |
| EM-7 (Invention) | 15 | 10 | 0.3 | 14.7 | 5 | 9.7 | 7.5 | 22 | 39 | 27 | 12 |
| EM-6 (Other than Invention) | 15 | 13 | 0.3 | 14.7 | 2 | 12.7 | 8.7 | 22 | 39 | 27 | 15 |
| EM-23 (Invention) | 15 | 10 | 1.5 | 13.5 | 5 | 8.5 | 7.9 | 22 | 39 | 27 | 12 |
| EM-24 (Invention) | 15 | 10 | 4.5 | 10.5 | 5 | 5.5 | 8.7 | 22 | 39 | 27 | 12 |
| EM-25 (Other than Invention) | 15 | 10 | 8 | 7 | 5 | 2 | 9.6 | 22 | 39 | 27 | 12 |
| EM-26 (Other than Invention) | 25 | 17 | 11 | 14 | 8 | 6 | 15.3 | 22 | 39 | 27 | 13 |

TABLE 17

| EM-No. | Ih mol % | Im mol % | Il mol % | ΔI = Ih − Il mol % | ΔIh = Im mol % | ΔIl = Im − Il mol % | Aggregate amount of iodide % | Volume of each shell Vh % | Vm % | Vl % | Veriation coefficient % |
|---|---|---|---|---|---|---|---|---|---|---|---|
| EM-5 (Other than Invention) | 15 | 15 | 0.3 | 14.7 | 0 | 14.7 | 9.5 | 22 | 39 | 27 | 17 |
| EM-9 (Other than Invention) | 15 | 0.3 | 0.3 | 14.7 | 14.7 | 0 | 3.8 | 22 | 39 | 27 | 16 |
| EM-4 (Invention) | 15 | 5 | 0.3 | 14.7 | 10 | 4.7 | 5.6 | 22 | 39 | 27 | 11 |
| EM-27 (Invention) | 15 | 5 | 0.3 | 14.7 | 10 | 4.7 | 5.6 | 22 | 39 | 27 | 9 |
| EM-28 (Invention) | 15 | 5 | 0.3 | 14.7 | 10 | 4.7 | 5.6 | 22 | 39 | 27 | 18 |
| EM-29 (Other than Invention) | 15 | 0.3 | 0.3 | 14.7 | 14.7 | 0 | 3.8 | 22 | 39 | 27 | 19 |
| EM-30 (Invention) | 15 | 5 | 0.3 | 14.7 | 10 | 4.7 | 5.6 | 22 | 39 | 27 | 32 |
| EM-31 (Other than Invention) | 15 | 0.3 | 0.3 | 14.7 | 14.7 | 0 | 3.8 | 22 | 39 | 27 | 34 |
| EM-15 (Invention) | 40 | 5 | 0.3 | 39.7 | 35 | 4.7 | 11.1 | 22 | 39 | 27 | 18 |
| EM-17 (Invention) | 50 | 5 | 0.3 | 49.7 | 45 | 4.7 | 12.2 | 22 | 39 | 27 | 35 |

TABLE 18

| EM-No. | Ih mol % | Im mol % | Il mol % | ΔI = Ih − Il mol % | ΔIh = Ih − Im mol % | ΔIl = Im − Il mol % | Aggregate amount of iodide % | Volume of each shell Vh % | Vm % | Vl % | Veriation coefficient % |
|---|---|---|---|---|---|---|---|---|---|---|---|
| EM-5 (Other than Invention) | 15 | 15 | 0.3 | 14.7 | 0 | 14.7 | 9.5 | 22 | 39 | 27 | 17 |
| EM-9 (Other than Invention) | 15 | 0.3 | 0.3 | 14.7 | 14.7 | 0 | 3.8 | 22 | 39 | 27 | 16 |
| EM-4 (Invention) | 15 | 5 | 0.3 | 14.7 | 10 | 4.7 | 5.6 | 22 | 39 | 27 | 11 |
| EM-32 (Invention) | 15 | 5 | 0.3 | 14.7 | 10 | 4.7 | 4.6 | 12 | 49 | 27 | 10 |
| EM-33 (Invention) | 15 | 5 | 0.3 | 14.7 | 10 | 4.7 | 4.0 | 5 | 56 | 27 | 10 |
| Em-34 (Invention) | 15 | 5 | 0.3 | 14.7 | 10 | 4.7 | 7.6 | 41 | 20 | 27 | 12 |

TABLE 19

| EM-No. | Ih mol % | Im mol % | Il mol % | ΔI = Ih − Il mol % | ΔIh = Ih − Im mol % | ΔIl = Im − Il mol % | Aggregate amount of iodide % | Volume of each shell Vh % | Vm % | Vl % | Veriation coefficient % |
|---|---|---|---|---|---|---|---|---|---|---|---|
| EM-5 (Other than Invention) | 15 | 15 | 0.3 | 14.7 | 0 | 14.7 | 9.5 | 22 | 39 | 27 | 17 |
| EM-9 (Other than Invention) | 15 | 0.3 | 0.3 | 14.7 | 14.7 | 0 | 3.8 | 22 | 39 | 27 | 16 |
| EM-4 (Invention) | 15 | 5 | 0.3 | 14.7 | 10 | 4.7 | 5.6 | 22 | 39 | 27 | 11 |
| EM-35 (Invention) | 25 | 10 | 5 | 20 | 15 | 5 | 11 | 22 | 39 | 27 | 12 |
| EM-36 (Invention) | 35 | 10 | 5 | 30 | 25 | 5 | 13.7 | 22 | 39 | 27 | 14 |
| EM-37 (Other than Invention) | 35 | 7.5 | 5 | 30 | 27.5 | 2.5 | 12.2 | 22 | 39 | 27 | 13 |
| EM-33 (Invention) | 15 | 5 | 0.3 | 14.7 | 10 | 4.7 | 4.0 | 5 | 56 | 27 | 10 |
| EM-38 (Invention) | 8 | 4 | 0.3 | 7.7 | 4 | 3.7 | 1.6 | 5 | 56 | 27 | 9 |
| EM-39 (Other than Invention) | 8 | 0.3 | 0.3 | 7.7 | 7.7 | 0 | 1.0 | 5 | 56 | 27 | 11 |

E. Examples:

Examples of the present invention will be detailed below:

<Example 1>

On a subbed transparent triacetate cellulose film support were coated in order the following two layers, and in thus manner three types of silver halide photographic light-sensitive material (Samples I–III) were prepared. In addition, the unit used below is per coated area ($m^2$).

| | |
|---|---|
| First layer: red sensitive silver halide emulsion layer | |
| Gelatin | 4 g/$m^2$ |
| Coupler-dispersed liquid | necessary quantity (coupler 0.035 mole) |
| Red-sensitive silver iodobromide emulsion | 2 g/$m^2$ |
| Second layer: protective layer | |
| Gelatin | 5 g/$m^2$ |
| Sensitizer I: | Anhydro-5,5'-dichloro-3,3'-di-(γ-sulfopropyl)-9-ethyl-thiacarbocyanine hydroxide pyridinium salt. |
| II: | Anhydro-9-ethyl-3,3'-di-(γ-sulfopropyl)-4,5,4'5'-dibenzothiacarbocyanine hydroxide-triethylamine salt. |

[Dispersion Liquid]

To 200 g of the cyan coupler shown in Table 20 were added 200 mg of trecresyl phosphate and 600 ml of ethyl acetate to prepare a solution by heating. The solution was added to a gelatin solution containing sodium triisopropylnaphthalenesulfonate and emulsifiedly dispersed by a colloid mill, and then the ethyl acetate was removed, whereby an minute oil-in-water dispersed liquid was prepared.

The prepared samples are as shown in Table 20.

TABLE 20

| Sample No. | EM No. used | Cyan coupler No. used | Remarks |
|---|---|---|---|
| Sample 1-1 | EM-5 | C-51 | Comparative |
| 1-2 | EM-10 | C-16 | " |
| 1-3 | EM-22 | C-3 | " |
| 1-4 | EM-4 | *CX-1 | " |
| 1-5 | EM-4 | C-51 | Invention |
| 1-6 | EM-12 | C-16 | " |

TABLE 20-continued

| Sample No. | EM No. used | Cyan coupler No. used | Remarks |
|---|---|---|---|
| 1-7 | EM-21 | C-3 | " |
| 187 | EM-33 | C-30 | " |

Note:
*CX-1 coupler: 1-hydroxy-4-(β-methoxyethylaminocarbonylmethoxy)-N-[δ-(2,4-di-t-amylphenoxy)butyl]-2-naphthoamide The thus obtained samples each was exposed through an optical wedge to a red light, and then developed in accordance with the following processing steps. After that, the obtained dye images each was evaluated. The bleaching in the following developing process took place under the pH conditions of 6.05 and 5.50. The obtained results are given in Table 21.

| Processing steps: | |
|---|---|
| Color developing | 3 minutes and 15 seconds |
| Bleaching | 6 minutes and 30 seconds |
| Washing | 3 minutes and 15 seconds |
| Fixing | 6 minutes and 30 seconds |
| Washing | 3 minutes and 15 seconds |
| Stabilizing | 1 minute and 30 seconds |
| Drying | |

The compositions of the processing solutions used in the respective processing steps are as follows:

| | |
|---|---|
| [Color Developer] | |
| 4-amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydroux potassium carbonate | 37.5 g |
| Sodium bromide | 1.3 g |
| Trisodium nitrilotriacetate, monohydrated | 2.5 g |
| Potassium hydroxide | 1.0 g |
| Water to make one liter | |
| [Bleaching Bath] | |
| Iron-ammonium ethylenediaminetetraacetate | 100.0 g |
| Diammonium ethylenediaminetetraacetae | 10.0 g |
| Ammonium bromide | 150.0 g |
| Glacial acetic acid | 10.0 g |
| Water to make one liter | |

-continued

| | |
|---|---|
| [Fixer] | |
| Ammonium thiosulfate | 175.0 g |
| Anhydrous sodium sulfite | 8.6 g |
| Sodium metasulfite | 2.3 g |
| Water to make one liter. | |
| Use acetic acid to adjust the pH to 6.0. | |
| [Stabilizing Bath] | |
| Formalin (37% aqueous solution) | 1.5 ml |
| Koniducks (product of Konishiroku Photo Ind. Co., Ltd.) | 7.5 ml |
| Water to make one liter | |

TABLE 21

| Sample No. | Bleaching bath pH 6.05 Sensitivity | Granularity (RMS) | Gamma | Bleaching bath pH 5.50 Sensitivity | Granularity (RMS) | Gamma |
|---|---|---|---|---|---|---|
| Sample 1-1 | 100 | 68 | 0.7 | 96 | 83 | 0.69 |
| 1-2 | 101 | 65 | 0.72 | 98 | 80 | 0.72 |
| 1-3 | 103 | 70 | 0.7 | 98 | 82 | 0.68 |
| 1-4 | 102 | 60 | 0.68 | 88 | 75 | 0.45 |
| 1-5 | 113 | 55 | 0.73 | 113 | 55 | 0.72 |
| 1-6 | 113 | 54 | 0.73 | 113 | 53 | 0.73 |
| 1-7 | 115 | 56 | 0.75 | 114 | 57 | 0.75 |
| 1-8 | 114 | 55 | 0.74 | 114 | 55 | 0.74 |

The sensitivity of each sample is shown in a value relative to the sensitivity of unprocessed Sample No. 1-1 regarded as 100.

RMS is shown with 1000-fold value of the standard deviation of the coefficient of variation of the density value obtained when scanning a color image having a dye image density of Dmin+0.6 by a microdensitometer with a scanning head having a rectangular opening area of 250 $\mu m^2$.

As is apparent from the results shown in Table 21, the present invention enables to obtain a photographic light-sensitive material which shows not only a stable color developability (showing little or no complex color) against the variation in the pH of the bleaching bath but also a high sensitivity and high image quality.

<Example 2>

On a subbed transparent cellulose triacetate film support having an antihalation layer (containing 0.40 g of black colloidal silver and 3.0 g of gelatin) were coated in order the following layes, whereby Sample No. 2-1 was prepared.

[Sample No. 2-1] . . . Comparative example.

Layer 1: Red-sensitive silver halide low-sensitivity emulsion layer (RL-1)

A red-sensitive silver halide low-sensitivity emulsion layer containing 1.8 g of an emulsion whose grains have the same composition and crystal habit as those of EM-4 but differ in the grain diameter alone (0.8$\mu$) and which is red-sensitized and a dispersion liquid prepared by dispersing into an aqueous gelating solution containing 1.85 g of gelatin a solution prepared by dissolving into 0.65 g of tricresy phosphate (TCP) 0.8 g of Exemplified Compound (C-30). 0.075 g of disodium 1-hydroxy-4-[4-(1-hydroxy-8-acetamido-3,6-disulfo-2-naphthylazo)-phenoxy]-N-[δ-(2,4-di-t-amylphenoxy)butyl]-2-naphthoamide (called CC-1), 0.015 g of 1-hydroxy-2-[δ-(2,4-di-t-amylphenoxy)-n-butyl]naphthoamide, 0.07 g of 4-octadecylsuccinimido-2-(1-phenyl-5-tetrazolylthio)-1-indanone (called D-1).

Layer 2: Red-sensitive silver halide high-sensitivity emulsion layer (RH-1)

A red-sensitive silver halide high-sensitivity emulsion layer containing 1.2 g of the above red-sensitizied emulsion and a dispersion liquid prepared by emulsifiedly dispersing into an aqueous gelatin solution containing 1.2 g of gelatin a TCP solution prepared by dissolving 0.21 g of Exemplified Compound (C-30), 0.02 g of Colored Cyan Coupler (CC-1) into 0.23 g of TCP.

Layer 3: Interlayer (IL)

An interlayer containing 0.8 g of gelatin and a solution of 0.07 g of 2,5-di-t-octylhydroquinone (called HQ-1) dissolved into 0.04 g of dibutyl phthalate (DBP).

Layer 4: Green-sensitive silver halide low-sensitivity emulsion layer (GL-1)

A green-sensitive silver halide low-sensitivity emulsion layer comprising 0.80 g of a AgBrI emulsion containing 7 mole% AgI (Emulsion-I) green-sensitized and a dispersion liquid prepared by emulsifiedly dispersing into an aqueous gelatin solution containing 2.2 g of gelatin a solution of [1-(2,4,6-trichlorophenyl)-3-[3-(2,4-di-t-amylphenoxyacetamido)benzamido]-5-pyrazolone [hereinafter called (M-1)], 0.15 g of 1-(2,4,6-trichlorophenyl)-4-(1-naphthylazo)-3-(2-chloro-5-octadecenylsuccinimidoanilino)-5-pyrazolone [hereinafter called Colored Magenta Coupler (CM-1)], and 0.01 g of DIR compound (D-1) dissolved into 0.95 g of TCP.

Layer 5: Green-sensitive silver halide high-sensitivity emulsion layer (GH-1)

A green-sensitive silver halide high-sensitivity emulsion layer comprising 1.8 g of an emulsion of AgBrI containing 6 mole% AgI (Emulsion-II) green-sensitized and a dispersion liquid prepared by emulsifiedly dispersing into an aqueous gelatin solution containing 1.9 g of gelatin a solution of 0.20 g of Magenta Coupler (M-1) and 0.049 g of colored Magenta Coupler (CM-1) dissolved into 0.25 g of TCP.

Layer 6: Yellow filter (YF)

An yellow filter layer comprising 0.15 g of yellow colloidal silver, a solution of 0.2 g of anticolor-stain agent (HQ-1) dissolved into 0.11 g of DBP and 1.5 g of gelatin.

Layer 7: Blue-sensitive silver halide low-sensitivity emulsion layer (BL-1)

A blue-sensitive silver halide low-sensitivity emulsion layer comprising 0.2 g of Emulsion-I blue-sensitized and a dispersion liquid prepared by emulsifiedly dispersing into an aqueous gelatin solution containing 1.9 g of gelatin a solution of 1.5 g of α-pivaloyl-α-(1-benzyl-2-phenyl-3,5-dioxyimidazolidine-4-yl)-2-chloro-5-[α-dodecyloxycarbonyl)ethoxycarbonyl]acetanilide (called Y-1) dissolved into 0.6 g of TCP.

Layer 8: Blue-sensitive silver halide high-sensitivity emulsion layer (BH-1)

A blue-sensitive silver halide high-sensitivity emulsion layer comprising 0.9 g of a 2 mole % AGI-containing AgBrI emulsion blue-sensitized and a dispersion liquid prepared by emulsifiedly dispersing into an aqueous gelatin solution containing 1.5 g of gelatin a solution of 1.30 g of Yellow Coupler (Y-1) dissolved into 0.65 g of TCP.

Layer 9: Protective layer (Pro)

A gelatin layer comprising 0.23 g of gelatin and a dispersion liquid containing polymethylmethacrylate particles (diameter of 2.5 $\mu$m) and the following ultraviolet absorbing agents UV-1 and UV-2.

UV-1: 2-(2-benzotriazolyl)-4-t-pentylphenol

UV-2: 2-[3-cyano-3-(n-dodecylaminocarbonyl)anilidene-1-ethylpyrolidine

Subsequently, Samples Nos. 2-2 through 2-10 were prepared in the same manner as in the above Sample No. 2-1 except that the cyan couplers and emulsions were replaced by those given in Table 2-1.

The thus obtained Samples 2-1 through 2-10 each was subjected to a three-day aging treatment under an atmospheric condition of 50° C./80%RH, and the treated piece and untreated piece of each same sample were wedge-exposed to a white light, and then developed in accordance with the following processing steps:

| Processing steps (38° C.) | |
|---|---|
| Color developing | 3 minutes and 15 seconds |
| Bleaching | 6 minutes and 30 seconds |
| Washing | 3 minutes and 15 seconds |
| Fixing | 6 minutes and 30 seconds |
| Washing | 3 minutes and 15 seconds |
| Stabilizing | 1 minute and 30 seconds |
| Drying | |

The compositions of the processing liquids used in the respective processing steps are as follows:

| | |
|---|---|
| [Color developer] | |
| 4-amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous sodium carbonate | 37.5 g |
| Sodium bromide | 1.3 g |
| Trisodium nitrilotriacetate, monohydrated | 2.5 g |
| Potassium hydroxide | 1.0 g |
| Water to make one liter | |
| [Bleaching bath] | |
| Iron-ammonium ethylenediamine tetraacetate | 100.0 g |
| Diammonium ethylenediamine tetraacetate | 10.0 g |
| Ammonium bromide | 150.0 g |
| Glacial acetic acid | 10.0 g |
| Water to make one liter. Use aqueous ammonia to adjust the pH to 6.0 | |
| [Fixer] | |
| Ammonium thiosulfate | 175.0 g |
| Anhydrous sodium sulfite | 8.5 g |
| Sodium metasulfite | 2.3 g |
| Water to make one liter. Use acetic acid to adjust the pH to 6.0. | |
| [Stabilizer] | |
| Formalin (37% aqueous solution) | 1.5 ml |
| Koniducks (product of Konishiroku Photo Ind. Co., Ltd.) | 7.5 ml |
| Water to make one liter. | |

The sensitometric and granularity data of the red-sensitive silver halide emulsion layers are given in Table 22.

TABLE 22

| | Sample No. | Emulsion | Cyan coupler | Non-aging Fog | Non-aging Sensitivity | Non-aging Granularity (RMS) | 30-day aging at 50° C./80% RH Fog | 30-day aging at 50° C./80% RH Sensitivity | 30-day aging at 50° C./80% RH Granularity (RMS) |
|---|---|---|---|---|---|---|---|---|---|
| Comparative Invention | 2-1 | EM-6 | C-30 | 0.18 | 100 | 58 | 0.24 | 74 | 65 |
| | 2-2 | EM-9 | C-30 | 0.18 | 102 | 57 | 0.23 | 77 | 67 |
| | 2-3 | EM-4 | C-30 | 0.13 | 161 | 48 | 0.13 | 160 | 48 |
| | 2-4 | EM-11 | C-30 | 0.14 | 155 | 50 | 0.15 | 153 | 50 |
| | 2-5 | EM-14 | C-47 | 0.15 | 155 | 50 | 0.16 | 155 | 51 |
| | 2-6 | EM-17 | C-47 | 0.13 | 158 | 49 | 0.13 | 156 | 52 |
| | 2-7 | EM-20 | C-57 | 0.15 | 155 | 48 | 0.15 | 154 | 50 |
| | 2-8 | EM-23 | C-57 | 0.14 | 154 | 50 | 0.15 | 154 | 50 |
| | 2-9 | EM-28 | C-49 | 0.15 | 156 | 51 | 0.16 | 153 | 53 |
| | 2-10 | EM-32 | C-49 | 0.15 | 156 | 48 | 0.15 | 155 | 51 |

As is apparent also from the results given in Table 22, according to the present invention, a high-sensitivity photographic light-sensitive material capable of producing a high-quality image and excellent in the stability in aging against high temperature and humidity can be obtained.

What is claimed is:

1. A silver halide photographic light-sensitive material comprising at least one silver halide emulsion layer, wherein said silver halide emulsion layer comprises a phenol-type cyan coupler having at the 2-position of the phenol nucleus thereof a group selected from the group consisting of a phenyl-ureido group, a naphthyl-ureido group and a heterocyclic ureido group, and having at the 5-position thereof an acylamino group, and a negative type silver halide grains of a core-shell structure which consists of an inner core essentially consisting of silver bromide or silver iodobromide and a plurality of shells essentially consisting of silver bromide or silver iodobromide, said plurality of shells comprising an outermost shell containing 0 to 10 mol% of silver iodide, a highly iodide-containing shell provided inside said outermost shell of which silver iodide content is at least 6 mol% higher than that of said outermost shell, and an intermediate shell provided between said outermost shell and said highly iodide-containing shell of which a silver iodide content is at least 3 mol% higher than that of said outermost shell, and at least 3 mol% lower than that of said highly iodide-containing shell.

2. The silver halide photographic light-sensitive material of claim 1 wherein said phenol type cyan coupler has the following Formula [Ia] or [Ib].

Formula [Ia]

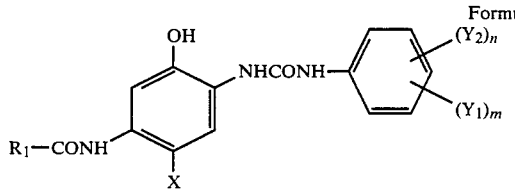

Formula [Ib]

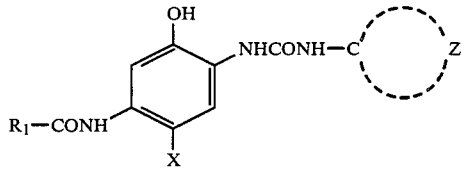

wherein $Y_1$ is trifluoromethyl, nitro, cyano, halogen, —COR, —COOR, —$SO_2R$, $SO_2OR$,

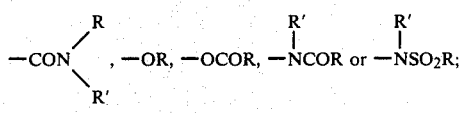

R is an aliphatic group or an aromatic group; R′ is hydrogen or a group represented by R; $Y_2$ is a monovalent group, m and n each is an integer of from 0 to 3, provided $m+n \leqq 5$, and Z is a group of nonmetallic atoms necessary to form a heterocyclic group or naphthyl group; $R_1$ represents an aliphatic group, an aromatic group or a heterocyclic group necessary to cause a cyan coupler having Formula [I] and the cyan dye formed from the cyan coupler to be nondiffusible; and X is hydrogen, halogen or a group which can be split off during the coupling reaction with the oxidized product of a color developing agent.

3. The silver halide photographic light-sensitive material of claim 2, wherein said $R_1$ shown respectively in said Formulae [Ia] and [Ib] is a group having the following Formula [Ic], Formula [Ic]

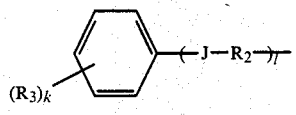

wherein J represents oxygen or sulfur; k is an integer of from 0 to 4, l is an integer of 0 or 1, where k is not less than 2 the not less than two $R_5$s each may be either the same or different; $R_4$ is a straight-chain or branched-chain alkylene group having from 1 to 20 carbon atoms; $R_5$ is a monovalent group.

4. The silver halide photographic light-sensitive material of claim 2, wherein a aliphatic group represented by R in said Formulae [Ia] and [Ib] is an alkyl group having 1 to 10 carbon atoms and an aromatic group represented by said R therein is a phenyl group.

5. The silver halide photographic light-sensitive material of claim 2, wherein said monovalent group represented by $Y_2$ in said respective Formlae [Ia] and [Ib] is an aliphatic group, an aromatic group, a halogen atom, an amino group, a hydroxy group or a substituent represented by $Y_1$ in said Formlae [Ia] and [Ib].

6. The silver halide photographic light-sensitive material of claim 5, wherein said aliphatic group represented by $Y_2$ in said Formlae [Ia] and [Ib] is an alkyl group having 1 to 10 carbon atoms and said aromatic group is a phenyl group or a naphthyl group.

7. The silver halide photographic light-sensitive material of claim 2, wherein said group of nonmetallic atoms necessary to form a heterocyclic group or naphthyl group, represented by Z in said Formula [Ib], is a 5- or 6-member heterocyclic ring containing 1 to 4 nitrogen, oxygen or sulfur atoms.

8. The silver halide photographic light-sensitive material of claim 2, wherein said aliphatic group, aromatic group or heterocyclic group represented by $R_1$ in said respective Formulae [Ia] and [Ib] is an alkyl group having 4 to 30 carbon atoms, an aryl group or a heterocyclic group.

9. The silver halide photographic light-sensitive material of claim 1, wherein said phenol type cyan coupler is contained in a silver halide emulsion layer, in a quantity of 0.02 to 0.5 mole per mole of the silver halide of said layer.

10. The silver halide photographic light-sensitive material of claim 1, wherein said phenol type cyan coupler is dispersed in the silver halide emulsion layer by being dissolved in an alkyl ester of phthalic acid.

11. The silver halide photographic light-sensitive material of claim 1, wherein the silver iodide content of said highly iodide containing-shell is within the range of 6 to 40 mol%.

12. The silver halide photographic light-sensitive material of claim 11, wherein the silver iodide content of said highly iodide containing-shell is within the range of 10 to 40 mol%.

13. The silver halide photographic light-sensitive material of claim 1, wherein the silver iodide content of said outermost shell is within the range of 0 to 5 mol%.

14. The silver halide photographic light-sensitive material of claim 13, wherein the silver iodide content of said outermost shell is within the range of 0 to 2 mol%.

15. The silver halide photographic light-sensitive material of claim 14, wherein the silver iodide content of said outermost shell is within the range of 0 to 1 mol%.

16. The silver halide photographic light-sensitive material of claim 1, wherein a difference of the silver iodide content between said intermediate shell and said outermost shell is within the range of 4 to 35 mol%.

17. The silver halide photographic light-sensitive material of claim 1, wherein a difference of the silver iodide content between said highly iodide-containing shell and said intermediate shell is within the range of 4 to 35 mol%.

18. The silver halide photographic light-sensitive material of claim 1, wherein a difference of the silver iodide content between said highly iodide-containing shell and said outermost shell is not less than 8 mol%.

19. The silver halide photographic light-sensitive material of claim 18, wherein a difference of the silver iodide content between said highly iodide-containing shell and said outermost shell is not less than 10 mol%.

20. The silver halide photographic light-sensitive material of claim 1, wherein silver iodide content of said inner core is within the range of 0 to 40 mol%.

21. The silver halide photographic light-sensitive material of claim 20, wherein silver iodide content of said inner core is within the range of 0 to 10 mol%.

22. The silver halide photographic light-sensitive material of claim 21, wherein silver iodide content of said inner core is within the range of 0 to 8 mol%.

23. The silver halide photographic light-sensitive material of claim 1, wherein a volume of said outermost shell is within the range of 4 to 70% of a whole volume of said silver halide grain.

24. The silver halide photographic light-sensitive material of claim 23, wherein a volume of said outermost shell is within the range of 10 to 50% of a whole volume of said silver halide grain.

25. The silver halide photographic light-sensitive material of claim 1, wherein a volume of said highly iodide-containing shell is within the range of 10 to 80% of the whole volume of said silver halide grain.

26. The silver halide photographic light-sensitive material of claim 25, wherein a volume of said highly iodide-containing shell is within the range of 20 to 50% of the whole volume of said silver halide grain.

27. The silver halide photographic light-sensitive material of claim 26, wherein a volume of said highly iodide-containing shell is within the range of 20 to 45% of the whole volume of said silver halide grain.

28. The silver halide photographic light-sensitive material of claim 1, wherein a volume of said intermediate shell is within the range of 5 to 80% of the whole volume of said silver halide grain.

29. The silver halide photographic light-sensitive material of claim 28, wherein a volume of said intermediate shell is within the range of 20 to 55% of the whole volume of said silver halide grain.

30. The silver halide photographic light-sensitive material of claim 1, wherein a size of said inner core is within the range of 0.05 to 0.8 μm.

31. The silver halide photographic light-sensitive material of claim 30, wherein a size of said inner core is within the range of 0.05 to 0.4 μm.

32. The silver halide photographic light-sensitive material of claim 1, wherein a whole content of silver iodide of said silver halide grain is within the range of 1 to 20 mol%.

33. The silver halide photographic light-sensitive material of claim 32, wherein a whole content of silver iodide of said silver halide grain is within the range of 1 to 15 mol%.

34. The silver halide photographic light-sensitive material of claim 33, wherein a whole content of silver iodide of said silver halide grain is within the range of 2 to 12 mol%.

35. The silver halide photographic light-sensitive material of claim 1, wherein said silver halide grains are in a monodispersed state.

36. The silver halide photographic light-sensitive material of claim 35, wherein a variation coefficient representing a dispersed state of said silver halide grains, which is defined by the equation, is not more than 20%:

$$\text{variation coefficient (\%)} = \frac{\text{standard deviation of grain size}}{\text{average grain size}} \times 100. \quad [A]$$

37. The silver halide photographic light-sensitive material of claim 36, wherein said variation coefficient is not more than 15%.

* * * * *